US011986083B2

(12) United States Patent
Stutz

(10) Patent No.: US 11,986,083 B2
(45) Date of Patent: May 21, 2024

(54) WEARABLE MAGNET HOUSING WITH INTERCHANGEABLE BACKING

(71) Applicant: MAGNETACTICAL LLC, Riverton, UT (US)

(72) Inventor: Devin Fredrickson Stutz, Riverton, UT (US)

( * ) Notice: Subject to any disclaimer, the term of this patent is extended or adjusted under 35 U.S.C. 154(b) by 0 days.

(21) Appl. No.: 17/736,233

(22) Filed: May 4, 2022

(65) Prior Publication Data

US 2022/0361652 A1 Nov. 17, 2022

Related U.S. Application Data

(60) Provisional application No. 63/187,121, filed on May 11, 2021.

(51) Int. Cl.

| | |
|---|---|
| ***A45F 5/02*** | (2006.01) |
| ***A44B 99/00*** | (2010.01) |
| *F41C 33/00* | (2006.01) |

(52) U.S. Cl.

CPC ..... *A45F 5/021* (2013.01); *A44B 99/00* (2013.01); *A44D 2203/00* (2013.01); *A45F 2200/0575* (2013.01); *F41C 33/008* (2013.01)

(58) Field of Classification Search

CPC .... A45F 5/00; A45F 5/02; A45F 5/021; A45F 2200/0591; F41C 33/041

See application file for complete search history.

(56) References Cited

U.S. PATENT DOCUMENTS

| | | | | |
|---|---|---|---|---|
| 5,452,497 | A * | 9/1995 | Peng | A45F 5/02 24/579.11 |
| 7,380,692 | B2 * | 6/2008 | Kostal | F41C 33/041 224/269 |
| 9,476,670 | B2 * | 10/2016 | Parsons | A45F 5/021 |
| 9,746,299 | B1 * | 8/2017 | Davis | F42B 39/02 |
| 2007/0226958 | A1 * | 10/2007 | Clifton, Jr. | F41C 33/041 24/3.12 |
| 2015/0013205 | A1 * | 1/2015 | Franklin | F41A 23/02 42/94 |

* cited by examiner

*Primary Examiner* — Corey N Skurdal
(74) *Attorney, Agent, or Firm* — Workman Nydegger

(57) ABSTRACT

Wearable housings are configured in size and shape to be securely attached to a strap, such as a belt, suspender, backpack strap, rifle strap, shoulder bag strap, vest, carrier, or other strap with one or more clasping members. One or more magnets are positioned within the substantially hollow receptacle area(s) of the wearable housing. The magnet(s) have sufficient holding force to securely hold a handgun or other item against the wearable housing for ready access.

17 Claims, 37 Drawing Sheets

WEARABLE MAGNET HOUSING WITH INTERCHANGEABLE BACKING

CROSS-REFERENCE TO RELATED APPLICATIONS

This application claims the benefit of and priority to U.S. Provisional Patent Application Ser. No. 63/187,121 filed on May 11, 2021 and entitled "WEARABLE MAGNET HOUSING WITH INTERCHANGEABLE BACKING." This application expressly incorporates herein the entirety of the foregoing application.

FIELD OF THE DISCLOSURE

The present invention generally relates to wearable clips or housings configured for holding one or more magnets and that are configured to be selectably connected to belts or other straps like structures.

BACKGROUND

Many utility items such as flashlights, knives, guns, and other handheld tools provide utility requiring manual manipulation and accessibility for proper use and function. In some instances, an item may need to be placed down or placed away for a moment, in order for a user to accomplish another task or use his/her hands for another purpose. Easy retrieval of many of these items is, therefore, desirable. As such, it is desirable that such items be placed or positioned in a location that is easily accessible, such as on the person that is actually utilizing the tool(s).

To accomplish the foregoing, many items can be tied or secured to a wearable strap, such as a belt. In other situations, a container or holster is used. While such approaches are beneficial, there is an ongoing need for improved products to aid in the containment or securing of tools and other items in a readily accessible manner.

More recently, some gun and tool mounting devices have been configured as wearable clips, to be secured to a belt or strap, with an internal magnet for detachably securing a tool in a position against the clip and corresponding belt/strap. However, despite the advantages provided by the existing clips, there are continued desires and needs for improving the utility and applicability of these types of mounting clips, so that they can be selectably secured to belts, straps and other mounting structures of different sizes and configurations.

BRIEF SUMMARY

Embodiments of the present disclosure include wearable housings or clips that are configured in size and shape to be attached to a strap, such as a belt, suspender, backpack strap, rifle strap, shoulder bag strap, vest, carrier, or other strap-like structure. Even more particularly, the disclosed embodiments are directed to wearable clips and housing configured for holding magnets and that include housings and interchangeable backings that are selectably secured to the housings. The different backings have looped structures or other clasping members that are sized and configured to accommodate secure attachment to belts, straps and other mounting structures of different sizes and configurations with the different corresponding backings.

Certain embodiments include one or more magnets positioned within a substantially hollow receptacle or housing that is configured to be attached directly to a belt or other strap-like structure. The magnet(s) and/or substantially hollow receptacle area(s) may be configured in size and shape so that the magnet(s) securely fit within the substantially hollow receptacle area(s).

Disclosed embodiments also include a backing for the wearable clip(s) or wearable housing(s) with one or more clasping members that are configured in size and shape to connect the wearable housing to the belt or strap-like structures. Some clasping members are connected to form a closed loop on the backing. Other backing configurations include clasping members that remain unconnected to provide a space between the clasping members, forming an unclosed loop.

Each of the disclosed backings is configured with mounting features that enable the backings to be selectively attached and detached from the wearable housing. In such embodiments, each housing is also configured with corresponding mounting features for being selectively attached and detached from the different backings that have different clasping member configurations, for enabling the housing to be selectively secured to belts, straps or other strap-like structures of different sizes.

Some embodiments also include a sizing block that is mounted within a loop or slot of the backing that is formed between the backing and the clasping member(s). The backing member is configured with mounting features for selectably and detachably mounting the sizing block at different locations within the loop of the backing, for selectably causing the loop to have different size dimensions for accommodating differently sized straps that are to pass through the loop.

Other aspects and advantages of the invention will be apparent from the following description and the appended claims. The various characteristics described above, as well as other features, will be readily apparent to those skilled in the art upon reading the following detailed description, and by referring to the accompanying drawings. This summary is therefore not intended to identify key or essential features of the claimed subject matter, nor is it intended to be used as an aid in limiting the scope of the claims.

BRIEF DESCRIPTION OF THE DRAWINGS

In order to describe various features and concepts of the present disclosure, a more particular description of certain subject matter will be rendered by reference to specific embodiments which are illustrated in the appended drawings. While each embodiment contemplated hereby may not be drawn to scale, at least some of the appended drawings may be drawn to scale. Understanding that these drawings depict just some example embodiments and are not to be considered to be limiting in scope, various embodiments will be described and explained with additional specificity and detail through the use of the accompanying drawings in which.

DETAILED DESCRIPTION

Figure 1A:
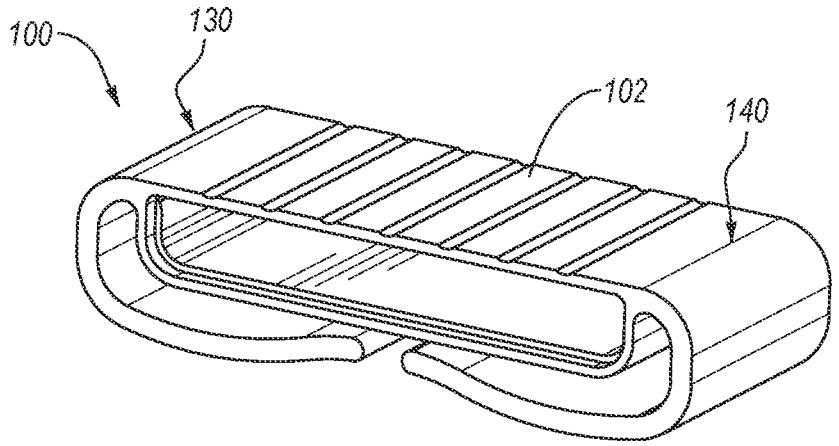
FIGS. 1A-1F illustrates multiple views of one embodiment of a wearable housing of the present disclosure.

The following is directed to various embodiments of the disclosure. The embodiments disclosed should not be interpreted, or otherwise used, to limit the scope of the disclosure including the claims. In addition, those having ordinary skill in the art will appreciate that the following description has broad application, and the discussion of any embodiment is not intended to suggest that the scope of the disclosure, including the claims, is limited to that embodiment.

Certain terms are used throughout the following description and claims to refer to particular features or components. As those having ordinary skill in the art will appreciate, different persons may refer to the same feature or component by different names. This document does not intend to distinguish between components or features that differ in name but not function. Certain features and components herein may be shown exaggerated in scale or in somewhat schematic form and some details of conventional elements may not be shown or described in interest of clarity and conciseness. As used in the specification and the appended claims, the singular forms "a," "an," and "the" are intended to include the plural forms as well, unless the context clearly indicates otherwise.

Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment.

The term "comprising" is to be interpreted synonymously with the phrases "having at least" or "including at least". When used in the context of a process, the term "comprising" means that the process includes at least the recited steps but may include additional steps. When used in the context of a compound, composition or device, the term "comprising" means that the compound, composition or device includes at least the recited features or components but may also include additional features or components. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

As used herein the term "strap" and "belt" are used interchangeably. It will be appreciated, however, that these terms can also include structures, such as, molle strapping or webbing, flaps, pockets, cords and other structures that are configured in size and shape to pass through the clasping structures and loops formed by the wearable housing structures of the invention.

FIGS. 1A-1G illustrate an embodiment of a wearable housing of the present disclosure, with FIG. 1A showing an isometric view, 1B showing a front view, 1C showing a back view, 1D showing a top view, 1E showing a bottom view and 1F showing a side view, wherein each of the two opposing sides are the same.

In these figures, a wearable housing 100 includes an outer wall 102 and an inner wall 104. The outer wall 102 and the inner wall 104 may be separated a predetermined distance from each other (e.g., a distance in a range of between about 0.125 inches and about 0.5 inches, or greater than 0.5 inches in some embodiments). The outer wall 102 and the inner wall are also connected by a first sidewall 106 and a second sidewall 108 by a distance within a range of between about 0.5 inches and about 3 inches, or even more than 3 inches.

In the embodiment shown, the outer wall 102, the inner wall 104, the first sidewall 106, and the second sidewall 108 connect to form a substantially hollow receptacle area 110 with a rectangular cuboid shape having angles that are approximately 90 degrees (i.e., are substantially right angles). In other embodiments, the outer wall 102, the inner wall 104, the first sidewall 106, and the second sidewall 108 may connect to form a substantially hollow receptacle area 110 with a different shape and/or with different vertex angles, such as a cube, rhombohedron, or parallelepiped.

As shown in FIGS. 1A through 1G, the outer wall 102, the inner wall 104, the first sidewall 106, and the second sidewall 108 may have faces or surfaces that are substantially flat. In other embodiments, the outer wall 102, the inner wall 104, the first sidewall 106, and/or the second sidewall 108 may include additional vertices, such that they connect to form a substantially hollow receptacle area 110 with a polyhedron shape that is non-cuboid, non-rhombohedron, and non-parallelepiped. For example, the outer wall 102, the inner wall 104, the first sidewall 106, and the second sidewall 108 may connect to form a substantially hollow receptacle area 110 that is a convex, concave, symmetrical, and/or asymmetrical polyhedron shape or other complex shape (not presently shown).

In other embodiments, the inner wall 104, the first sidewall 106, and/or the second sidewall 108 may be curved or may include a curved portion, such that the outer wall 102, the inner wall 104, the first sidewall 106, and the second sidewall 108 do not form hard or identifiable edges at every connection. For example, the outer wall 102, the inner wall 104, the first sidewall 106, and the second sidewall 108 may connect to form a substantially hollow receptacle area 110 that is substantially ellipsoid in shape and/or that has an elliptical shaped cross section or partially elliptical shaped cross section.

The wearable housing 100 may be manufactured out of plastic, metal, ceramic, fabric, or any other material or combination of materials configured in size and shape to include a substantially hollow receptacle area 110 capable of housing one or more magnets of sufficient size and strength to accommodate a user's needs and preferences.

The wearable housing may be constructed to be substantially solid (i.e., the walls and other members of the housing are solid pieces of material) or may be constructed as a framework or skeleton design (i.e., walls and other members of the housing are framings or outlines with striated, webbed, or other shaped openings within).

The substantially hollow receptacle area 110 may be hollow, such that no other portions of the wearable housing 100 project into the open space of the substantially hollow receptacle area 110. In other embodiments, the substantially hollow receptacle area may not be completely hollow. For example, support structures, partitions, projections, mold production artifacts or other objects may occupy a portion of the space within the substantially hollow receptacle area 110, such as the fins described below and as shown in at least FIGS. 2A-2C.

Figure 1B:
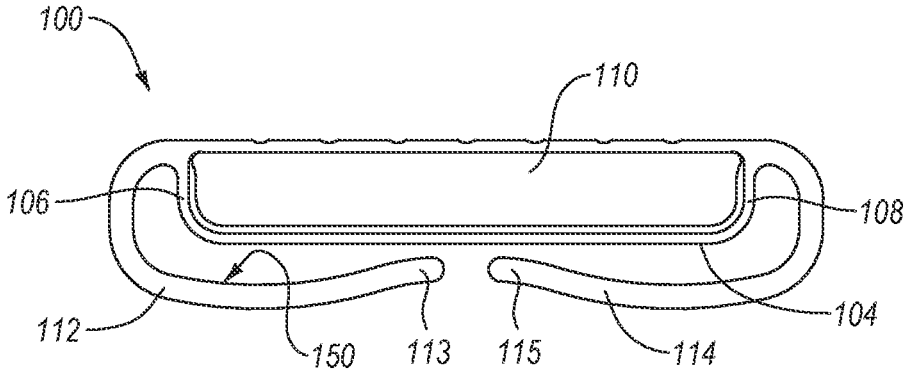
Figure 1C:
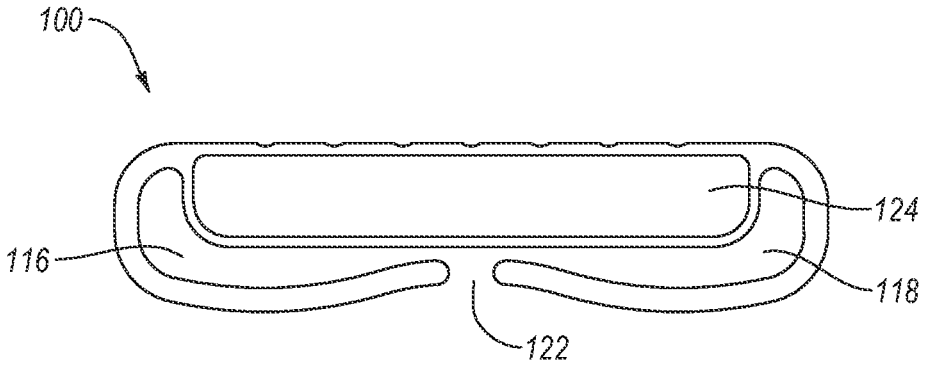
Figure 1D:
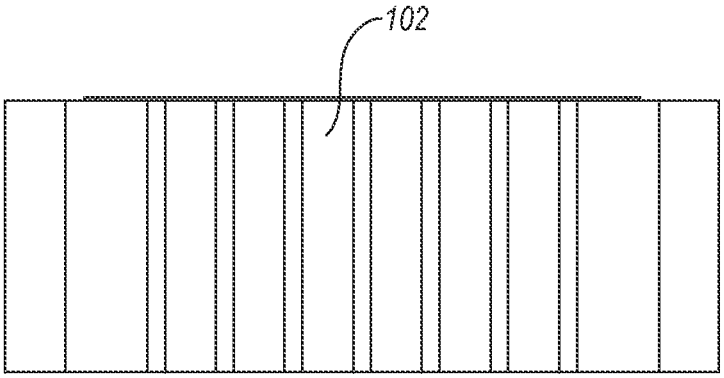
Figure 1E:
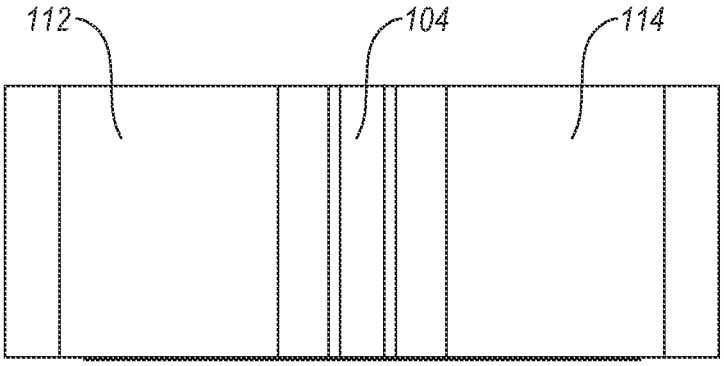
Figure 1F:
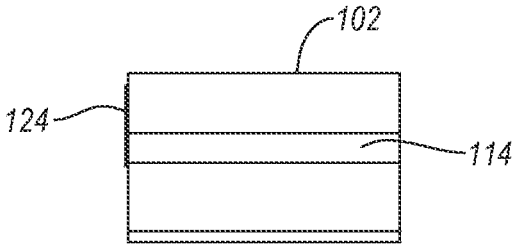

In the embodiment of FIGS. 1A-1C, the outer wall 102 includes corresponding exterior and interior surfaces (e.g., a surface that is exterior to the substantially hollow receptacle area 110 and a surface that is interior to the substantially hollow receptacle area 110) and the inner wall 104 includes a corresponding interior and an exterior surface.

The embodiment shown in FIGS. 1A through 1G also includes a first clasping member 112 and a second clasping member 114. In some embodiments, the first clasping member 112 is disposed at a first end of the outer wall 102 and extends around the inner wall 104 to a terminating end 113 adjacent to the exterior surface of the inner wall 104. Similarly, the second clasping member 114 is disposed at a second end of the outer wall 102 and extends around the inner wall 104 to a terminating end 115 adjacent to the exterior surface of the inner wall 104. The first clasping member 112 forms a first slot 116 defined by the area between the first clasping member 112 and the exterior surface of the inner wall 104, and the second clasping member 114 forms a second slot 118 defined by the area between the second clasping member 114 and the exterior surface of the inner wall 104.

In the embodiment shown in FIGS. 1A-1G, the first clasping member 112 and the second clasping member 114 are disposed from or protrude from first and second ends of the outer wall, respectively. In other embodiments, the clasping members may be disposed from or protrude from other areas of the wearable housing (see, e.g., FIG. 8 and FIGS. 9A-9C). For example, the first clasping member 112 may extend away from an area proximate the first end 130 of the outer wall 102 or from the first sidewall 106 or from both before extending to the terminal point 113 adjacent to the exterior surface of the inner wall 104. Likewise, the second clasping member 114 may be disposed from an area proximate the second end 140 of the outer wall 102 or from the second sidewall 108 or from both before extending to the terminal point 115 adjacent to the exterior surface of the inner wall 104.

As illustrated by the embodiment shown in FIGS. 1A-1G, a clasping member may also have one or more curved or arcuate portions. For example, a clasping member 112,114 may include one or more portions 150 that curve out or away from the exterior surface of the inner wall 104 and/or one or more portions that curve in or toward the exterior surface of the inner wall 104.

In some embodiments, the housing only has a single clasping member. In other embodiments, three, four, or more clasping members are included, such that there may be a plurality of clasping members disposed from a first end of the outer wall and/or from the first sidewall and/or a plurality of clasping members disposed from a second end of the outer wall and/or from the second sidewall.

In the embodiment shown in FIGS. 1A-1G, the first clasping member 112 and the second clasping member 114 have widths that are substantially the same as the widths of the outer wall 102 and the inner wall 104. This width can vary in size to accommodate different needs and preferences. In some embodiments, the width is within a range of about 0.5 inches and 2 inches. In other embodiments, the width is less than 0.5 inches or more than 2 inches.

In yet embodiments, the widths of the outer wall 102, the inner wall 104, the first clasping member 112, and the second clasping member 114 are not the same. For example, the widths of the first clasping member 112 and/or the second clasping member 114 may be wider or smaller than the outer wall 102 and/or inner wall 104. Additionally, or alternatively, the widths of the first clasping member 112 and/or the second clasping member 114 may be non-uniform and/or may taper in one direction or the other. The outer wall 102 and the inner wall 104 may also have different widths, and they may be non-uniform and/or may taper in one direction or the other.

In the embodiment shown in FIGS. 1A-1G, the first clasping member 112 and the second clasping member 114 have terminating ends 113 and 115 that do not coincide or abut one another, leaving a gap 122. In other embodiments, discussed in more detail below, the gap 122 may be narrower or wider (see, e.g., FIGS. 5 and 6). Alternatively, the clasping members may form an enclosed loop, effectively omitting any gap (see, e.g., FIG. 7).

Figure 1G:
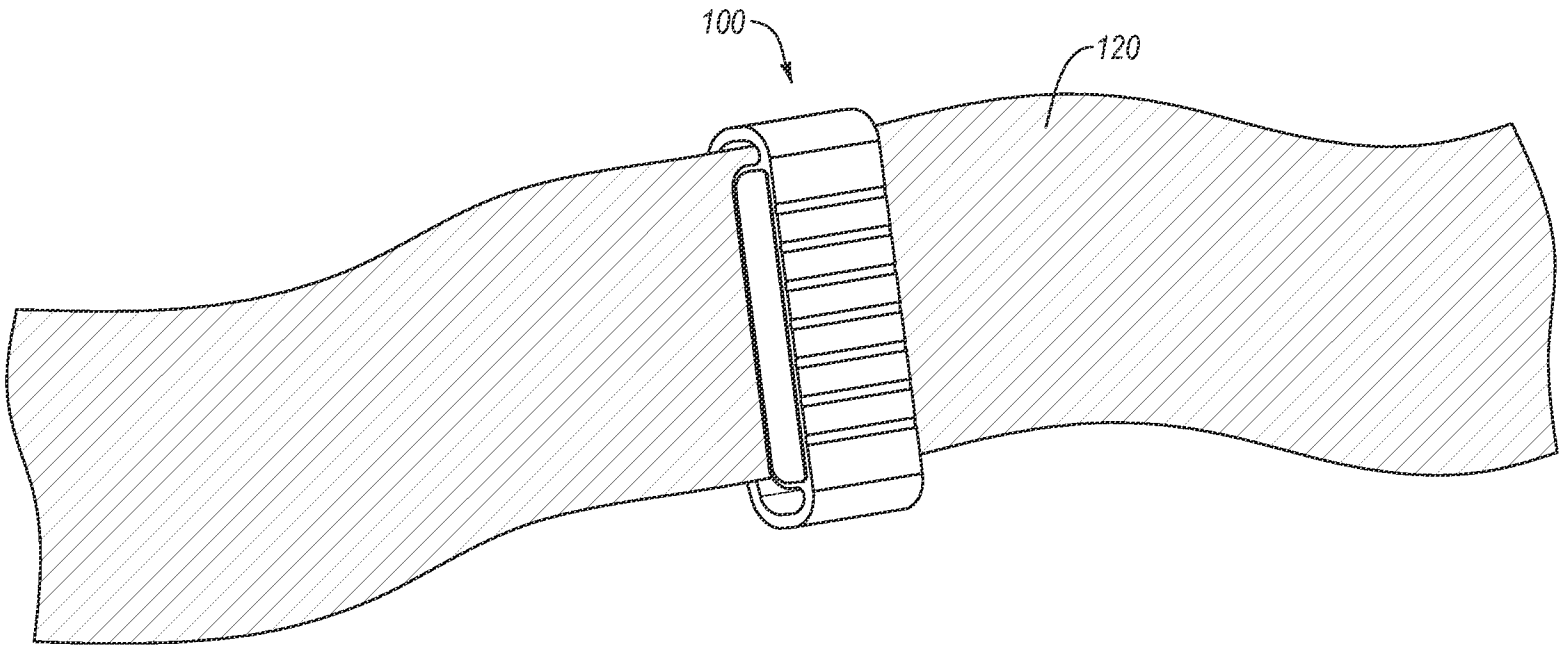
FIG. 1G illustrates a wearable housing attached to a strap.

FIG. 1G illustrates that embodiments of the present disclosure may be configured for attachment to or association with a strap 120 or strap like structure. A strap 120 may be a wearable strap, such as a belt (e.g., tactical, military, law-enforcement, utility, casual), suspender, shoulder strap, backpack strap, rifle strap, vest, carrier, or any other form of material with at least a portion including a substantially flat cross section. Additionally, or alternatively, the strap 120 may be constructed in a rope or cord-like fashion, such that a cross-section is not necessarily flat or substantially flat. The strap can also be a partial strap, such as a pocket. The wearable housing 100 may be attached or associated with a strap 120 by positioning the strap into the first slot 116 and/or second slot 118 of the wearable housing 100.

In some embodiments, the clasping members may be configured to secure the wearable housing 100 firmly in place against the strap 120 to prevent lateral and vertical movement along the strap 120. For example, the clasping members 112, 114 may be configured such that the first slot 116 and second slot 118 have one or more portions that are narrower than the thickness of a strap 120, thereby being configured to flex against and secure a strap 120 when the wearable housing 100 is positioned on a strap 120. The spacing between the exterior surface of the inner wall 104 and the clasping members 112 and/or 114 can vary to accommodate different needs and preferences. In some embodiments, the clasping members are configured to be positioned between about 0.03125 of inches and about 0.25 inches from the exterior surface of the inner wall. The flexible characteristics of the clasping members can also vary (e.g., resulting from different materials and material thicknesses of the clasping members). The thickness of the clasping members can be, in some embodiments, between about 0.03125 inches and about 0.25 inches.

In alternative embodiments, the clasping members may be configured to allow unrestricted lateral movement along the strap 120, such that the wearable housing 100 is freely slidable along the strap 120 into different positions along the strap 120. Additionally, or alternatively, the clasping members may be configured to allow vertical movement along the strap 120. In some embodiments (such as those embodiments including only one clasping member), a wearable housing may be connected to a strap with only one clasping member. For example, the clasping members 112,114 may be configured to not flex against a strap 120 or to flex against a strap 120 gently enough to allow movement of the housing 100 along the strap 120.

In some embodiments, a wearable housing 100 includes a back wall 124 connected to the first side wall 106, the second sidewall 108, the outer wall 102, and the inner wall 104, thereby further enclosing the substantially hollow receptacle area 110 at a first end of the substantially hollow receptacle area 110. The back wall 124 may be substantially flat, as in FIGS. 1A-1G, or may include additional vertices and/or include curved portions.

The outer wall 102 may include a textured pattern, such as the grooved pattern shown in at least FIGS. 1A-1G. A textured pattern may be formed by one or more grooves or other indentations formed into the exterior surface of the outer wall 102, by one or more projections formed on the exterior surface of the outer wall 102, or by a combination of grooves/indentations and projections. The textured pattern may be isotropic or anisotropic.

In some embodiments, such as those shown in at least FIGS. 1A-1G, the textured pattern may be disposed in a transverse direction (i.e., grooves or projections or both run transversely). In other embodiments, the textured pattern may be disposed longitudinally, diagonally, or in a combination of two or more directions, or with portions that run in one direction and other portions that run in another direction. In some embodiments, the textured pattern is a diamond, honeycomb, radial, or other complex pattern (see, e.g., FIGS. 4A and 4B). One of skill in the art will note that any combination of these patterns may be used, such that the outer wall 102 may be uniformly or non-uniformly textured, and that some, all, or none of the outer wall 102 may exhibit a textured pattern. The texturing can help prevent or resist sliding of a tool positioned against the surface.

Figure 2A:
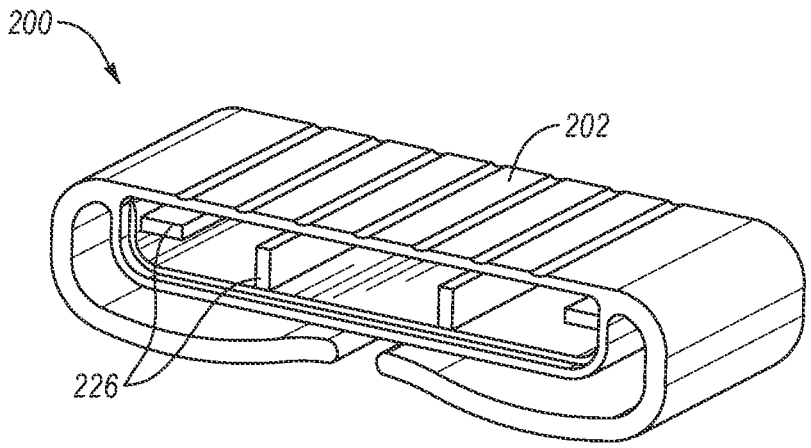
FIGS. 2A and 2B illustrate an embodiment of a wearable housing including support fins.
Figure 2B:
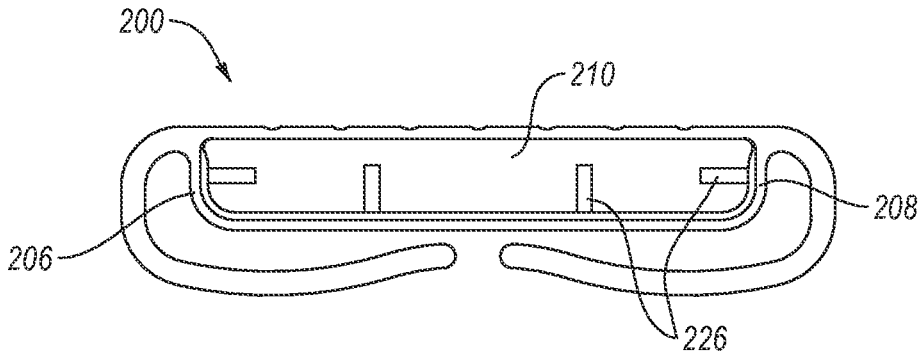

In the embodiment illustrated in FIGS. 2A and 2B, a wearable housing 200 includes one or more support fins 226. In some embodiments, support fins 226 may be disposed on one or more of the back walls (not shown), first side wall 206, second sidewall 208, outer wall 202, and/or inner wall 204, and may extend a distance into the substantially hollow receptacle area 210. The support fins 226 may be utilized to position and/or secure a magnet within the substantially hollow receptacle area 210 (see also FIGS. 3A-3C and discussion thereof). The support fins 226 may be disposed longitudinally, transversely, diagonally, circularly, in a curved path, or may have portions running in one direction and other portions running in another direction. Additionally, or alternatively, some support fins 226 may run in one direction or combination of directions while other support fins 226 run in another direction or combination of directions. One of skill in the art will understand that any number of support fins 226 may be used in any combination to position a magnet within a substantially hollow receptacle area 210.

Figure 3A:
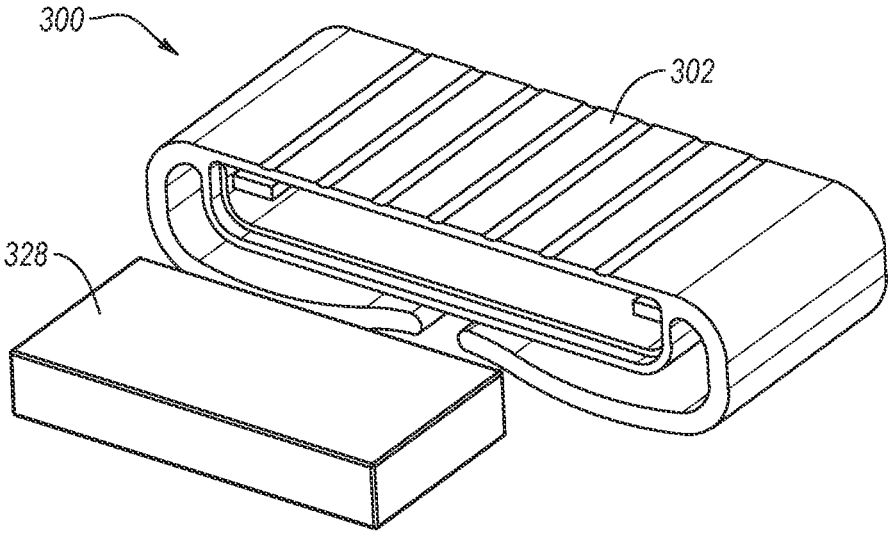
FIGS. 3A-3C illustrate a wearable housing and a magnet, and the positioning of the magnet within a substantially hollow receptacle area of the wearable housing.
Figure 3B:
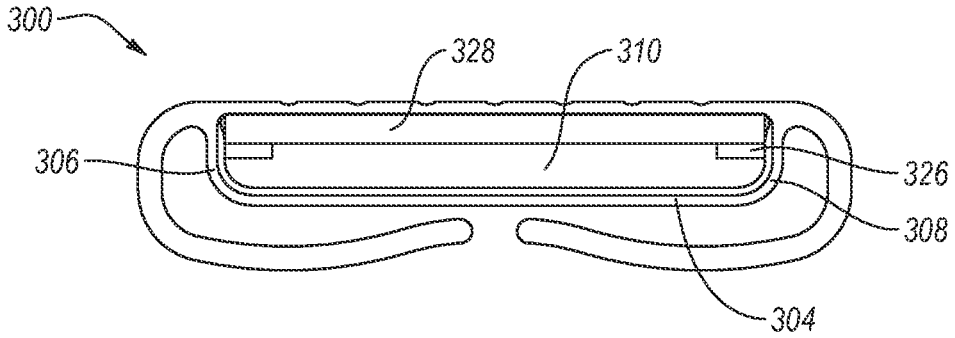
Figure 3C:
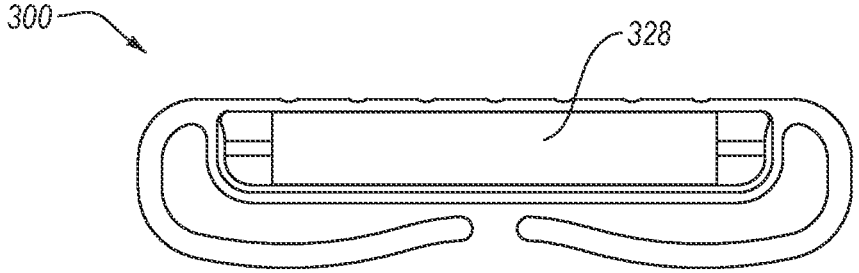

FIGS. 3A-3C illustrate an embodiment of a wearable housing 300 including a magnet 328. As shown in the figures, a magnet 328 may be positioned within or partially within a substantially hollow receptacle area 310. The magnet 328 and/or substantially hollow receptacle area 310 may be configured in size and shape so that the magnet 328 fits securely within the substantially hollow receptacle area 310. For example, the magnet 328 may be positioned within the substantially hollow receptacle area 310 such that the magnet 328 abuts against one or more support fins 326, as shown in FIGS. 3B and 3C.

The support fins 326 may aid in securely positioning the magnet 328 within the substantially hollow receptacle area 310 by maintaining the magnet 328 at a desired location within the substantially hollow receptacle area 310. For example, support fins 326 may secure the magnet 328 against the outer wall 302. Additionally, or alternatively, support fins 326 may secure the magnet against the first sidewall 306, second sidewall 308, inner wall 304, back wall (not shown), and/or another support fin or support fins 326.

As illustrated in FIGS. 3A-3C, the magnet 328 and/or substantially hollow receptacle area 310 may be configured in size and shape so that the magnet 328 fills a portion of the volume of the substantially hollow receptacle area 310. For example, the magnet 310 may fill 10% or less of the volume. In other embodiments, the magnet may fill more than 10% of the volume, such as between 10-25%, or 25-50%, or 50-75%. In other embodiments, the magnet may fill substantially all of the volume of the substantially hollow receptacle area 310, such as 75-100% of the volume. In such an embodiment, the wearable housing 300 may not include support fins, and the magnet 328 may abut and be secured in position by the outer wall 302, the first sidewall 306, second sidewall 308, the inner wall 304 and the back wall.

In some embodiments, the magnet 328 and/or substantially hollow receptacle area 310 may be configured in size and shape such that the magnet 328 is completely contained within the substantially hollow receptacle area 310 during use. In other embodiments, a portion or portions of the magnet 328 may reside outside of the substantially hollow receptacle area 310. For example, in some embodiments, a portion of the magnet 328 may protrude out of an opening of the substantially hollow receptacle area 310 on one side or end of the wearable housing 300. In another example, a portion of the magnet 328 may protrude out of an opening of the substantially hollow receptacle area 310 on two sides or ends of the wearable housing 300 (e.g., in embodiments of a wearable housing not exhibiting a back wall).

While the support fins described above can help secure the magnet(s) in place, it will be appreciated that other securing means can also be used, such as adhesives and friction fits between the interior surfaces of the housing.

The magnet 328 may be formed of any material capable of exhibiting a magnetic force (e.g., a permanent magnet). In some embodiments, the magnet 328 may be a rare-earth magnet, such as, but not limited to neodymium magnets (i.e., neodymium-iron-boron magnets) and samarium-cobalt magnets. In some embodiments, the size and grade of the magnet 328 is sufficient to create a pull force of greater than 0.25 lbs. or, even more preferably, greater than 0.5 lb. In other embodiments, the size and grade of the magnet 328 is sufficient to create a pull force of greater than about 1.0 lb., and even more preferably greater than about 2 lbs. In other embodiments, the size and grade of the magnet 328 is sufficient to create a pull force of between about 2 lbs. and about 10 lbs. In other embodiments, the size and grade of the magnet 328 is sufficient to create a pull force of greater than about 5 lbs., such as more than about 10 lbs. or even more than about 20 lbs. In some particular embodiments, the size and grade of the magnet 328 is sufficient to create a pull force of between about 20 lbs. and about 35 lbs., between about 35 lbs. and 50 lbs., and even more particularly greater than about 50 lbs.

Figure 4A:
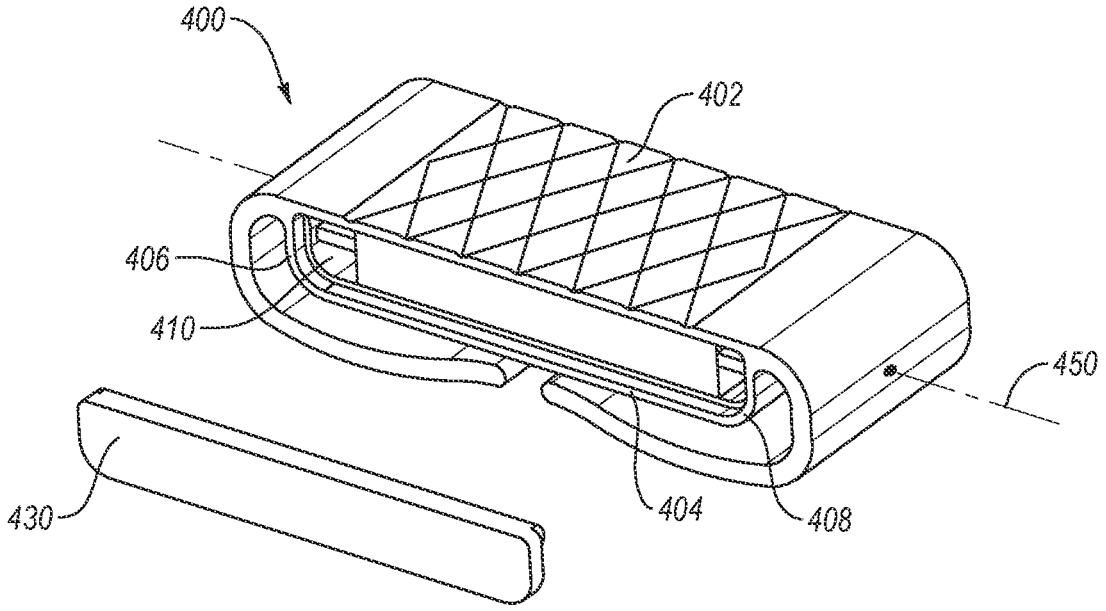
FIGS. 4A and 4B illustrate a wearable housing and a cap and a detachable cap.
Figure 4B:
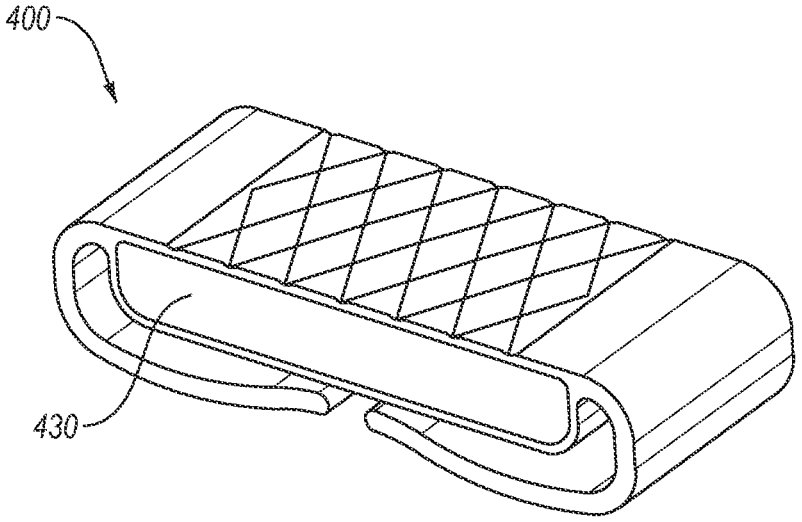

FIGS. 4A and 4B illustrate an embodiment of a wearable housing 400 including a cap 430. The cap 430 may be configured to be detachably connected to the first sidewall 406, second sidewall 408, outer wall 402, and inner wall 404 on a side/end of the wearable housing 400 opposite the back wall (not shown). The cap 430 may thereby further enclose the substantially hollow receptacle area 410 at a second end of the substantially hollow receptacle area 410. The cap 430 may be substantially flat, as in FIGS. 4A and 4B, or may include additional vertices and/or include curved portions.

In some embodiments, the cap 430 may be attached to the wearable housing 400 by configuring the cap 430 to fit securely within a portion of the substantially hollow receptacle area 410. For example, the cap 430 may be configured to fit within the portion of the substantially hollow receptacle area 410 proximate the second end of the substantially hollow receptacle area 410. In some embodiments, the wearable housing 400 may include a countersink disposed along the outer wall 402, inner wall 404, first sidewall 406, and/or second sidewall 408, or portions thereof. The countersink portion may aid in positioning and securing the cap 430 on the wearable housing 400 at the opening (i.e., at the second end of the substantially hollow receptacle area 410).

In other embodiments, at least a portion of the cap 430 may be attached or integrally connected to another portion of the wearable housing 400. For example, the cap 430 may include a tab or hinge (not presently shown) connecting the cap to another portion (e.g., the outer wall 402, inner wall 404, first sidewall 406, and/or second sidewall 408) of the wearable housing 400. In these embodiments, the tab or hinge may keep the cap 430 attached to the remainder of the wearable housing 400 even when the cap 430 is not positioned to enclose the second end of the substantially hollow receptacle area 410. In these embodiments, a cap 430 may be detached or disengaged from the housing (e.g., to gain access to the substantially hollow receptacle area 410), but not completely detached from the remainder of the wearable housing 400. For example, the cap 430 may be detached or disengaged from enclosing the substantially hollow receptacle area 410 by folding it up, down, or sideways along a tab or hinge connecting the cap 430 to the wearable housing 400. In other embodiments, the cap 430 may be integrally formed with the remainder of the wearable housing 400, such that it is not detachable.

The cap 430 can also be integrally attached to the housing by sonic welding, by chemical adhesives or other fastening means.

Figure 5:
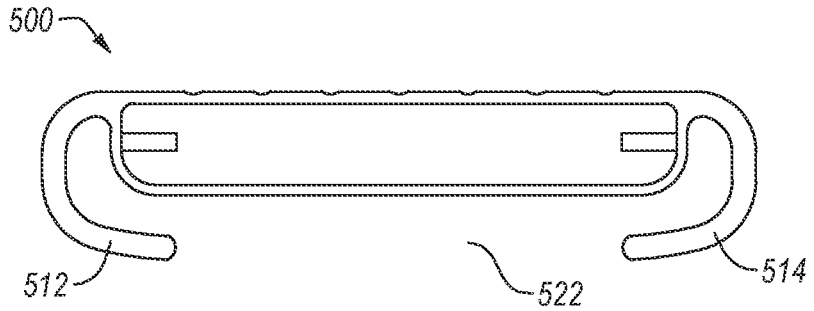
FIGS. 5 and 6 illustrate embodiments of wearable housings including clasping members of various sizes and shapes.

FIGS. 5-8 illustrate other wearable housing embodiments with a variety of clasping member and/or slot variations. FIG. 5 illustrates a wearable hosing 500 including a first clasping member 512 and a second clasping member 514. In this embodiment, the first clasping member 512 and the second clasping member 514 have terminating ends that do not coincide or abut one another, leaving a gap 522. Likewise, in the embodiment shown in FIG. 6, a wearable housing 600 includes a first clasping member 612 and a second clasping member 614 with terminating ends that do not coincide or abut one another, leaving a gap 622. However, gap 622 is significantly smaller than the gap 522 of FIG. 5. The gap 522 can be larger when the clasping members 512 and 514 are sufficiently rigid to remain attached to a sufficiently rigid strap or belt. However, when the strap and/or the clasping members are relatively more flexible, it is desirable to provide longer clasping members that are capable of remaining attached to the strap.

Figure 6:
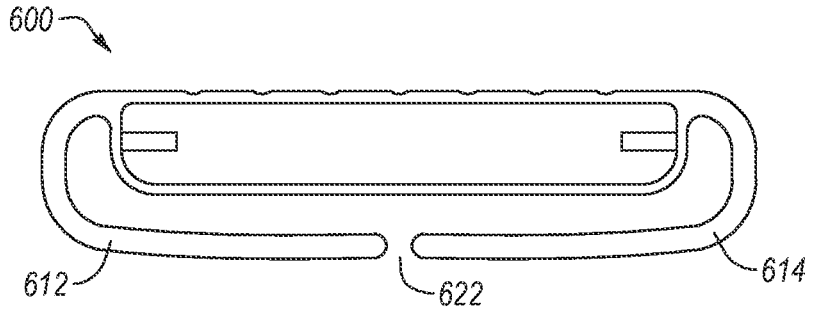

The embodiments illustrated in FIGS. 5 and 6 show that the clasping members may be configured in a variety of different sizes and shapes. For example, a gap 522 or 622 may be relatively wide or narrow, depending on the configuration of the clasping members. Likewise, a gap 522 or 622 may be symmetrically positioned relative to a centerline of the housing (such as shown with regard to centerline 450 of FIGS. 4A and 4B).

In some embodiments, the opposing clasping members are the same length. In other embodiments, one of the clasping members is longer than the opposing clasping member, such that the center of the gap is longitudinally offset from the center of the housing.

In the embodiments shown in FIGS. 5 and 6, the clasping members (512, 514, 612 and 614) have a uniform thickness. In other embodiments, clasping members may have a thickness that is non-uniform. For example, one or more clasping members may have a thickness that tapers and/or expands in one direction or the other.

Figure 7:
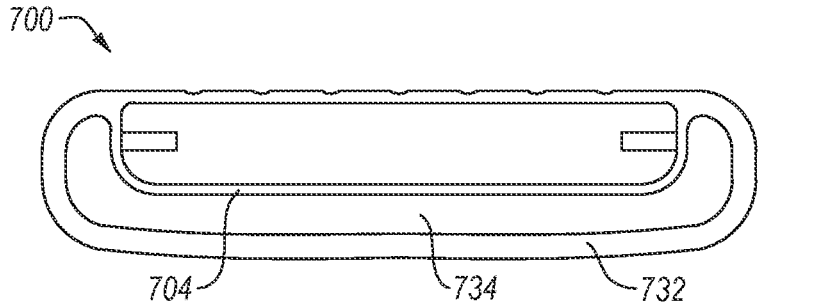
FIG. 7 illustrates a wearable housing including an enclosed loop and an enclosed slot formed by connected clasp members.

FIG. 7 illustrates an embodiment of a wearable housing 700 including an enclosed loop 732 that is formed by two clasping members being integrally connected (with no terminating ends). The enclosed loop 732 forms an enclosed slot 734 defined by the area between the enclosed loop 732 and the exterior surface of the inner wall 704. In this particular embodiment, the wearable housing 700 may be attached to a strap (not shown) by positioning the strap through the enclosed slot 734. As with the other embodiments including one or more clasping members, an enclosed loop may have a uniform or non-uniform thickness and may be substantially straight or may include one or more curved or arcuate portions. Additionally, the enclosed loop 732 may be configured to flex and apply a friction force with strap to securely engage the wearable housing 700 in a desired positioning on the strap. Or, alternatively, the enclosed loop can be configured with sufficient spacing and rigidity that it does not flex to allow the housing to be moved along the strap.

Figure 8:
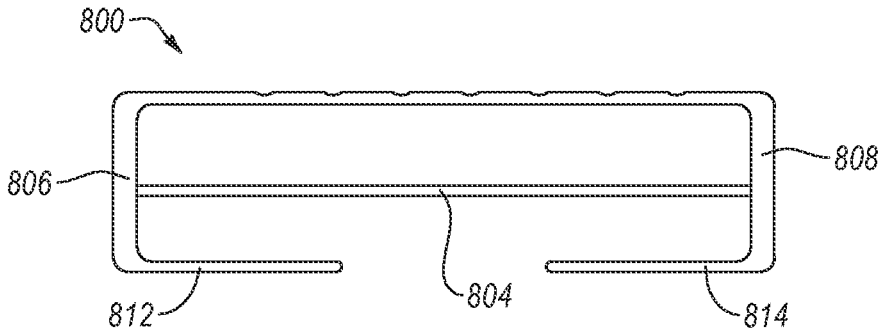
FIG. 8 illustrates another embodiment of a wearable housing with clasping members extending directly away from sidewalls.

FIG. 8 illustrates another embodiment of a wearable housing 800 including a first clasping member 812 and a second clasping member 814. In the embodiment shown in FIG. 8, the first clasping member 812 protrudes laterally directly down from the first sidewall 806 and the second clasping member 814 protrudes laterally down from the second sidewall 808, parallel to the first clasping member and perpendicular to the outer and inner walls. Both of the first clasping member 812 and the second clasping member 814 extend to a terminating end adjacent to the exterior surface of the inner wall 804.

In other embodiments, the one or more clasping members protrude longitudinally away from the outer walls parallel to the outer and inner walls (see, e.g., FIGS. 5-7), and in yet other embodiments, one or more clasping members may be disposed from the inner wall.

Figure 9A:
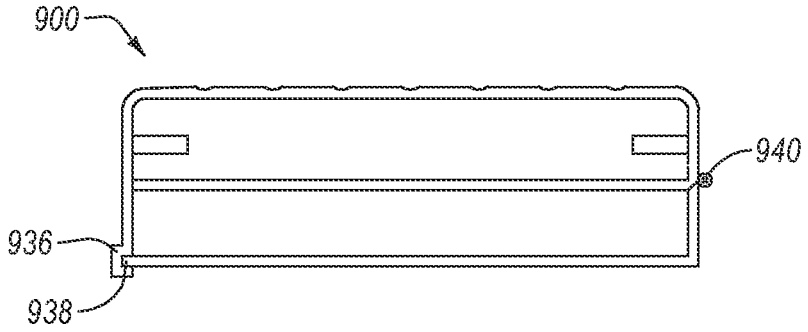
FIGS. 9A-9C illustrate a wearable housing with clasping members including hinging and locking elements.
Figure 9B:
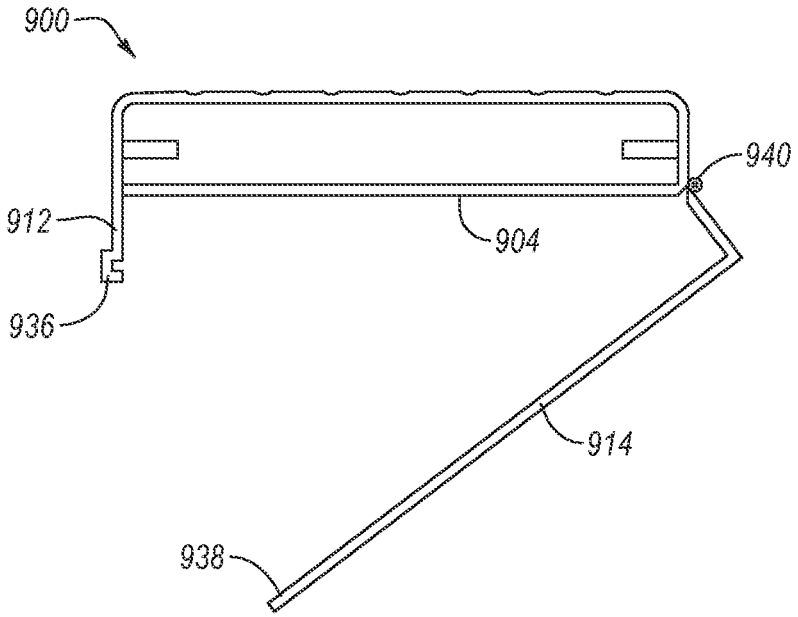
Figure 9C:
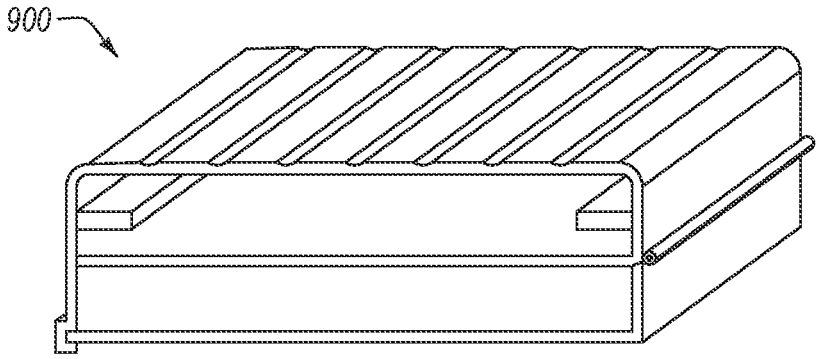

FIGS. 9A-9C illustrate another embodiment of a wearable housing 900 including a first clasping member 912 and a second clasping member 914 that extend to terminal ends that coincide and abut each other at the same location to form an enclosed loop. In the embodiment shown in FIGS. 9A-9C, the first clasping member 912 also includes a first locking element 936, and the second clasping member 914 includes a second locking element 938. The first locking element 936 and the second locking element 938 may be configured to detachably connect or engage with each other when the first and second clasping members are connected to form the closed loop.

In some embodiments, the wearable housing also includes a clasping member hinge 940 configured to allow a clasping member to turn on the clasping member hinge 940 as the first locking element 936 and the second locking element 938 detach and disengage from each other to open the closed loop and re-separate the first clasping member 912 and second clasping member 914. The hinge 940 can be composed of a plurality of hinge elements enabling rotation about a central axis. Alternatively, the hinge can be composed of a recessed portion of the material between the sidewall and the clasping member, which is thin enough to enable the clasping member to flex about the recessed portion.

Figure 10A:
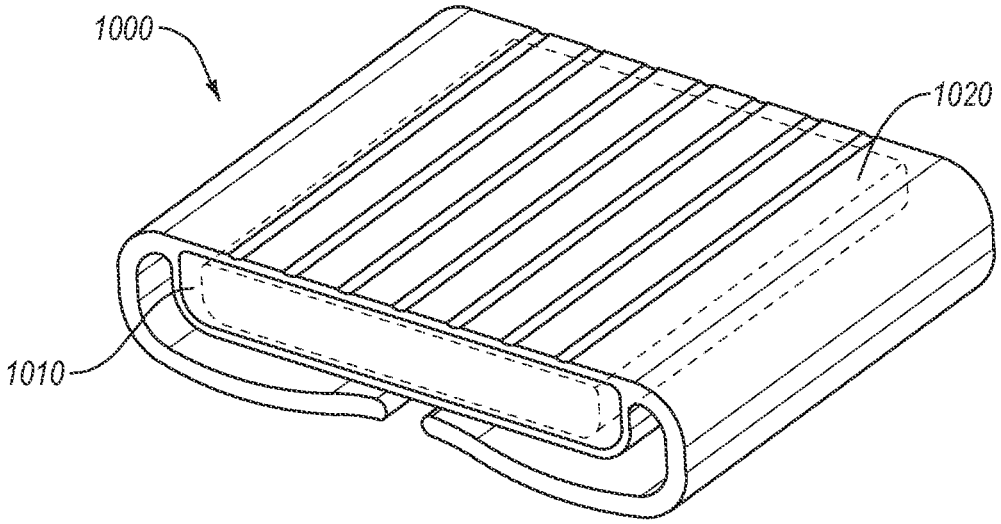
FIGS. 10A-10C illustrate embodiments of wearable housings including enlarged and a plurality of receptacle areas.
Figure 10B:
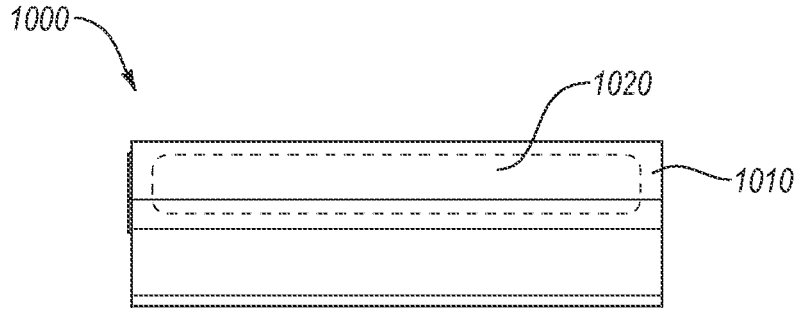
Figure 10C:
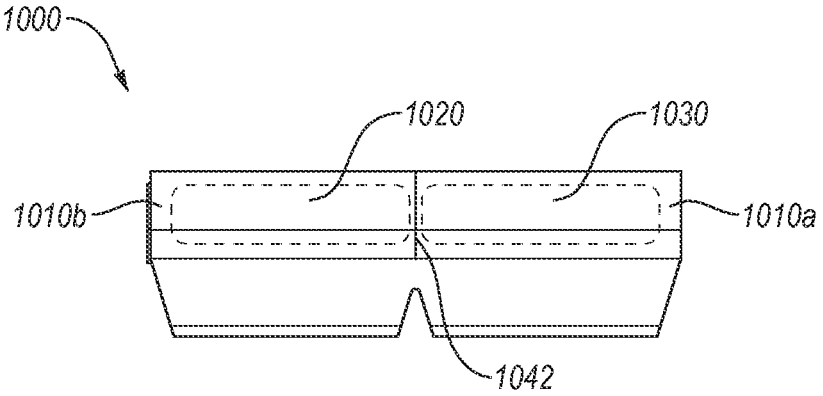

FIGS. 10A-10C illustrate another embodiment of a wearable housing 1000 including an extended or enlarged receptacle area 1010. The wearable housing 1000 may, for example, be configured in size and shape to hold two or more magnets within the substantially hollow magnetic receptacle area 1010. For example, two or more magnets can be positioned side by side within the substantially hollow receptacle area 1010. Alternatively, a single enlarged magnet can be positioned within the receptacle area 1010.

As described herein, the wearable housing 1000 is configured to hold any quantity and size of magnets to provide the desired amount of magnetic holding force (e.g., 2+lbs) at the surface area of the outer wall to hold the tools or objects positioned there.

As shown in the embodiment illustrated by FIG. 10C, a wearable housing 1000 may also include one or more partitions 1042 configured to divide the substantially hollow receptacle area into one or more receptacle areas (1010*a* and 1010*b*), and one or more magnets (1020 and 1030) may then be positioned within each of the one or more receptacle areas, respectively. The partition 1042 may be substantially straight or may include vertices and/or curved or arcuate portions. The partition 1042 can extend completely or only partially between the outer and inner sidewalls.

The embodiments of FIGS. 10A-10C show the housing to be relatively wider than in the other embodiments. It will be appreciated, however, that the overall width of the housing can vary to accommodate any need or preference. Accordingly, the width can vary from less than 0.5 inches to more than three inches. Similarly, the height of the housing can also vary to accommodate different needs and preferences, including the need to accommodate different sized straps and belts. Accordingly, the height can vary from less than 0.05 inches to more than four inches. Although, in some embodiments, the height is between about one inch and three inches.

In some embodiments, the height of the housing is greater than the width of the housing. In other embodiments, the width is greater than the height.

In some embodiments, the wearable housing is configured for modular functionality, such that a plurality of separate wearable housings can be positioned on a single belt or strap, including MOLLE strapping.

Figure 11A:
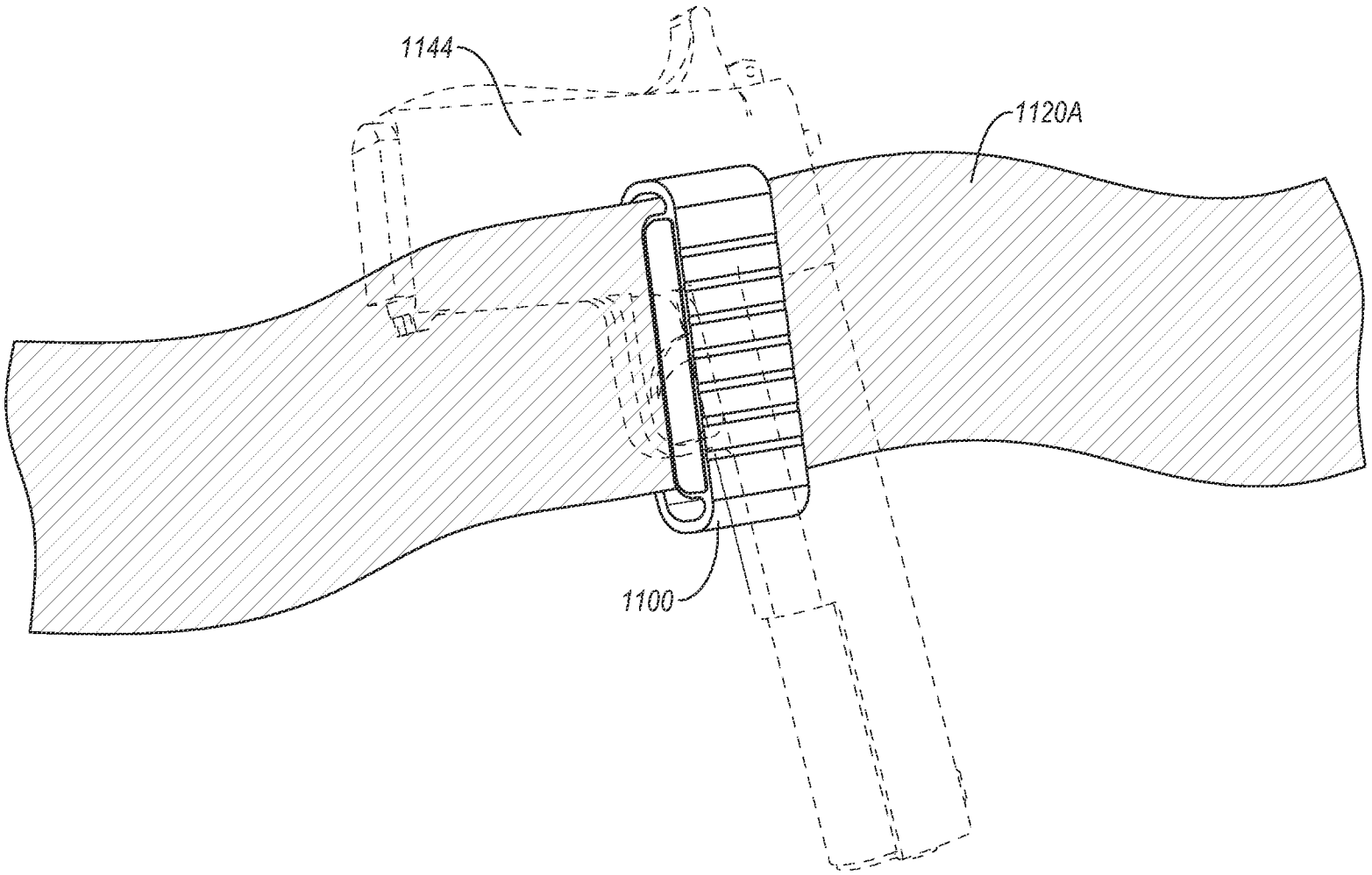
FIGS. 11A-11B illustrate two different embodiments of wearable housings connected to a strap/belt and a utility item (e.g., a firearm) magnetically associated with the wearable housings and secured in place against the wearable housings.

The embodiment illustrated in FIG. 11A includes a wearable housing 1100 attached to a strap 1120A (which may be a belt or other type of strap). The embodiment illustrated in FIG. 11 shows that a utility item, such as a firearm like handgun 1144, can be selectably attached to the wearable housing 1100. For example, the utility item 1144 (or two or more such utility items) may be detachably secured against the outer wall 1102 of the wearable housing by the magnetic force of the magnet(s) positioned within the wearable housing 1100.

While the present example illustrates that a handgun 1144 can be attached to and held in place against the wearable housing 1100, it will be appreciated that other utility items can also be used, so long as they are ferrous or exhibit characteristics of magnetic attraction. For example, the utility item 1144 can also comprise a handheld tool (e.g., hammer, wrench, screwdriver, tape measurer, level, etc.), hardware (e.g., nails, screws, rivets, etc.), flashlight, or other handheld or hand manipulated item capable of magnetic attraction.

It will be appreciated from the foregoing, that the wearable housing is capable of providing many advantages over existing holsters and containers known in the prior art. Among other things, the present invention provides a mechanism that is capable of selectably securing one or more items in an accessible position that might not be as accessible with a traditional holster or container, thereby overcoming some of the difficulty that could otherwise be required to open the container or holster. This advantage is particularly apparent when considering circumstances in which only a single hand is available, such as during many tool operations or during one-handed drawing, shooting, and reloading of a handgun.

Figure 11B:
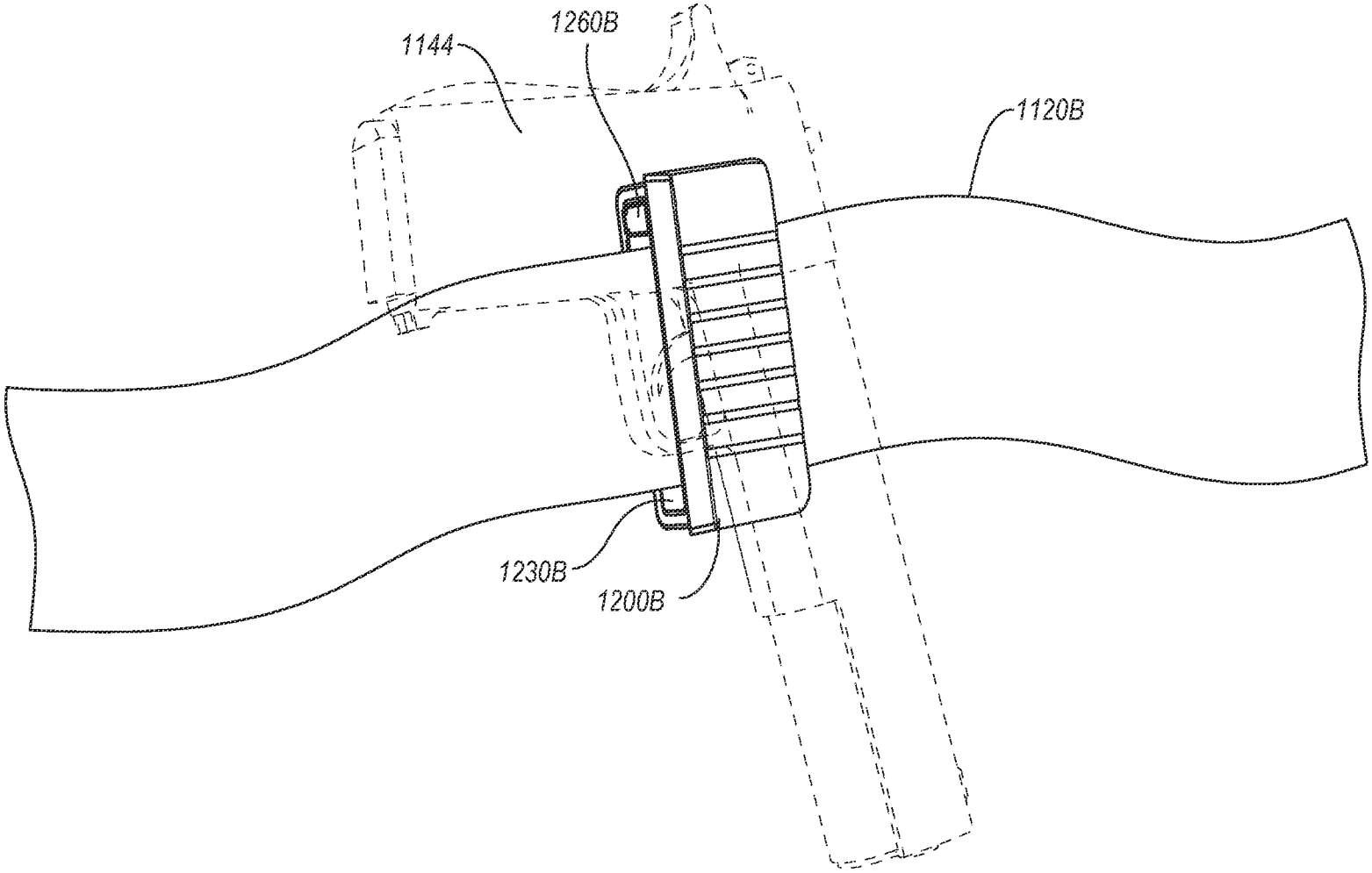

The embodiment illustrated in FIG. 11B is similar to the embodiment of FIG. 11A, and also includes a wearable housing 1200B, which is attached to a strap 1120B. However, in this embodiment, the strap 1120B is narrower than the strap 1120A. Nonetheless, the wearable housing 1200B it is still attached and held securely in place on the strap 1120B, even though the strap 1120B is narrower. This is possible, for example, by reducing the size of the loop formed within the clasping member(s) of the wearable housing 1200B, relative to the loop formed within the clasping member(s) of the wearable housing 1200A. This narrowing of the loop is caused by the presence of a spacing or sizing block 1260B that is fastened within the loop 1230B. The configuration of wearable housing 1200B and other related configurations will now be described in reference to FIGS. 12-32.

FIGS. 12-32 describe how various housing assemblies/clips 1200A, 1200B, and 1200C can be formed from corresponding housing components (i.e., housings 1203A, 1203B, 1203C) and interchangeable backings (i.e., backings 1220A, 1220B, 1220C, respectively), that each form a loop 1230A, 1230B, 1230C, respectively, from corresponding mounting structures of the interchangeable backings. The sizes of the loops (where a strap is secured during use) can also be selectably modified by the positioning of a spacing block within the loop(s), as will be described in more detail below.

Figure 12:
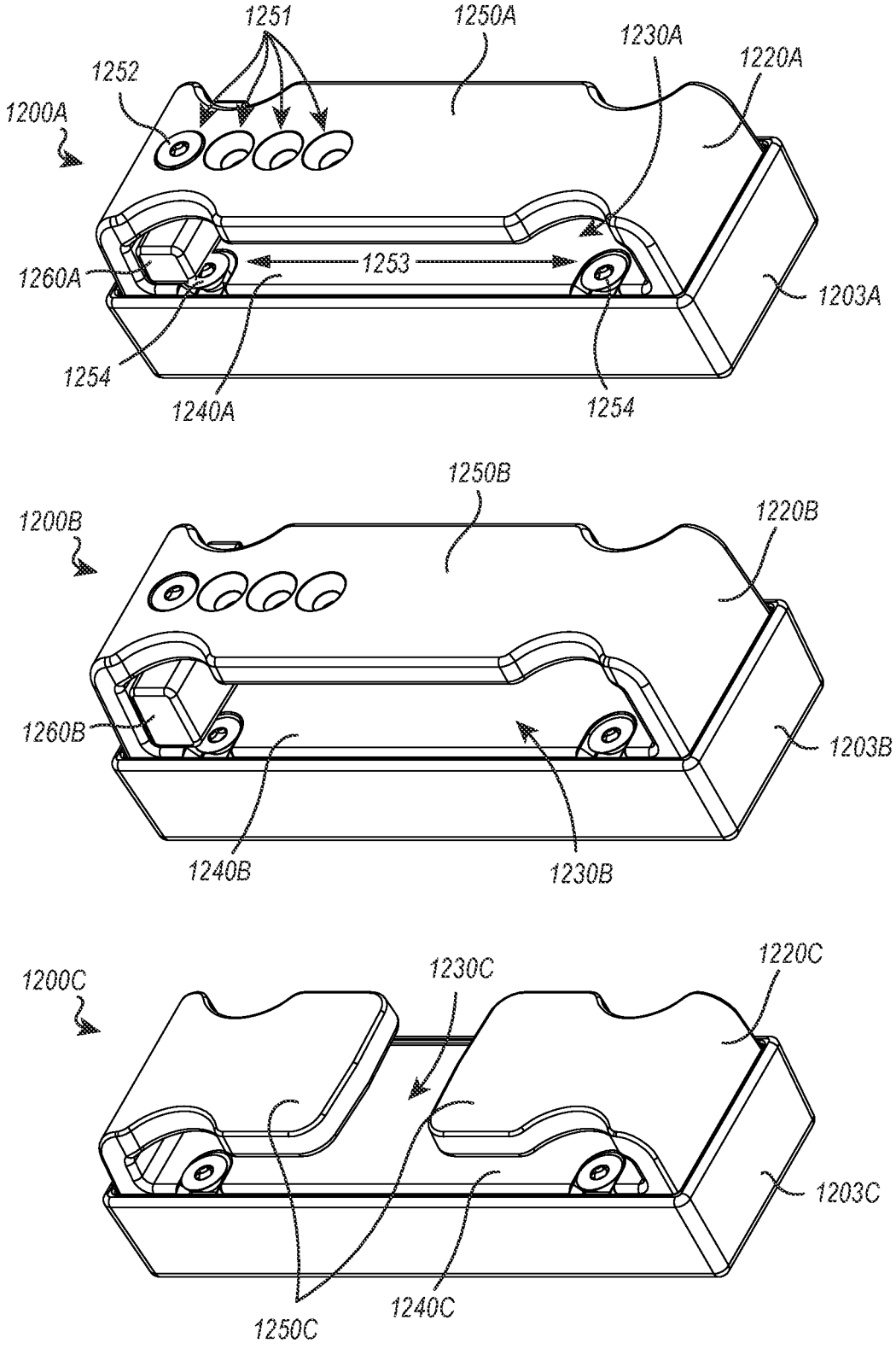
FIG. 12 illustrates a back top perspective view of three different wearable housings or wearable clips having housings of a same configuration that are each attached to a differently configured backing structure.
Figure 13:
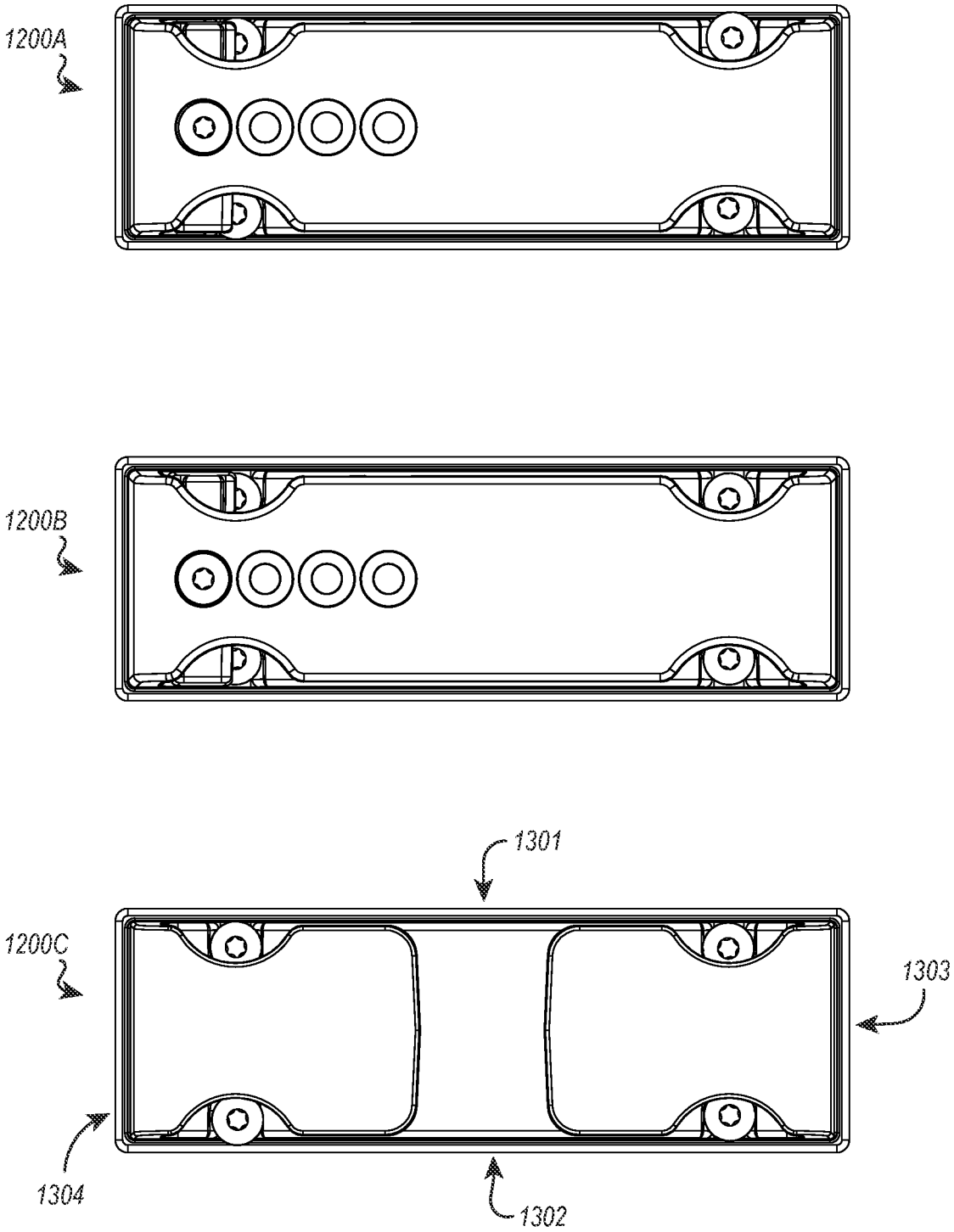
FIGS. 13-18 illustrate corresponding bottom views (FIG. 13), top views (FIG. 14), frontside views (FIG. 15), backside views (FIG. 16), right side views (FIG. 17), and left side views (FIG. 18), respectively, of the different wearable housings shown in FIG. 12.
Figure 14:
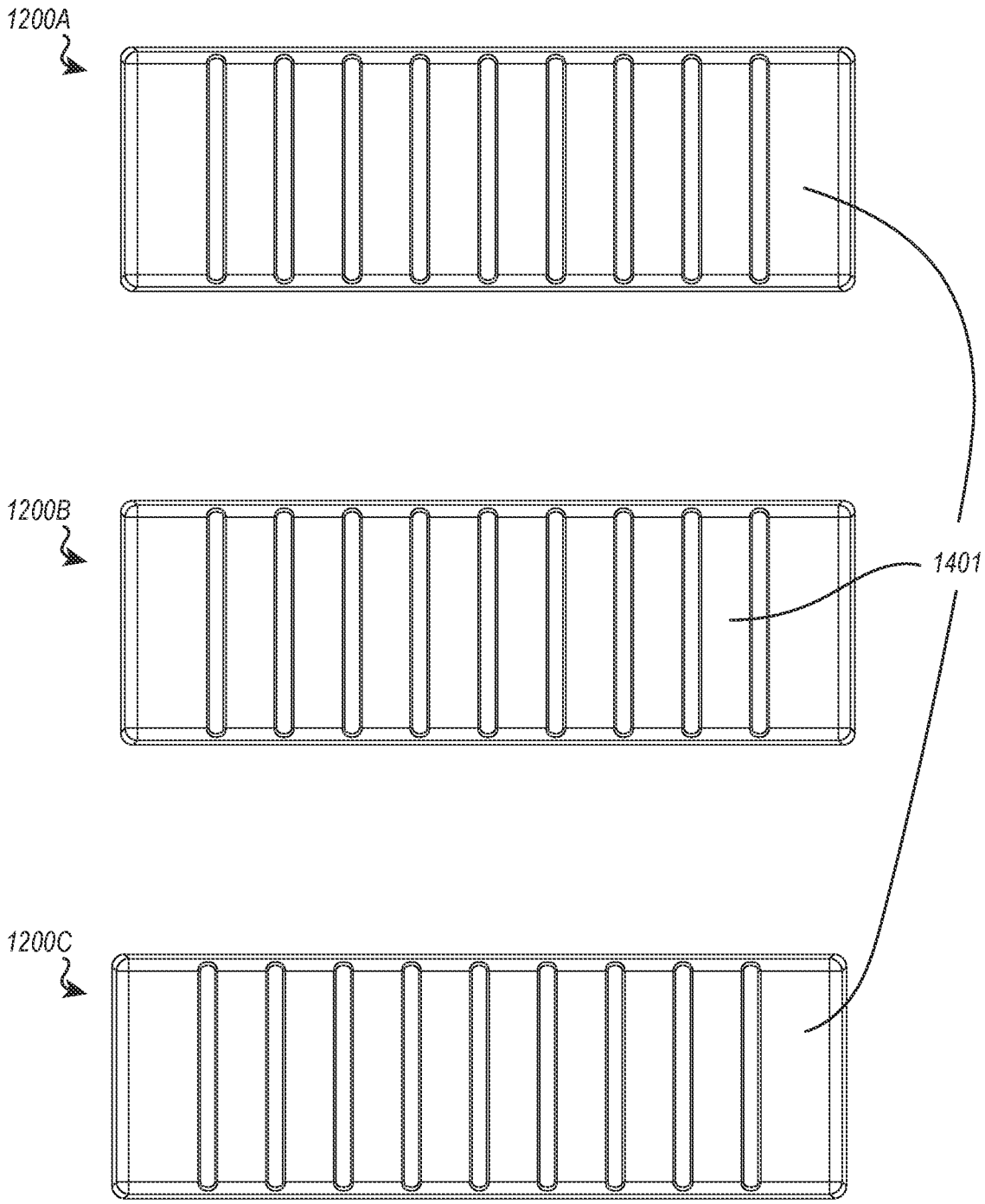
Figure 15:
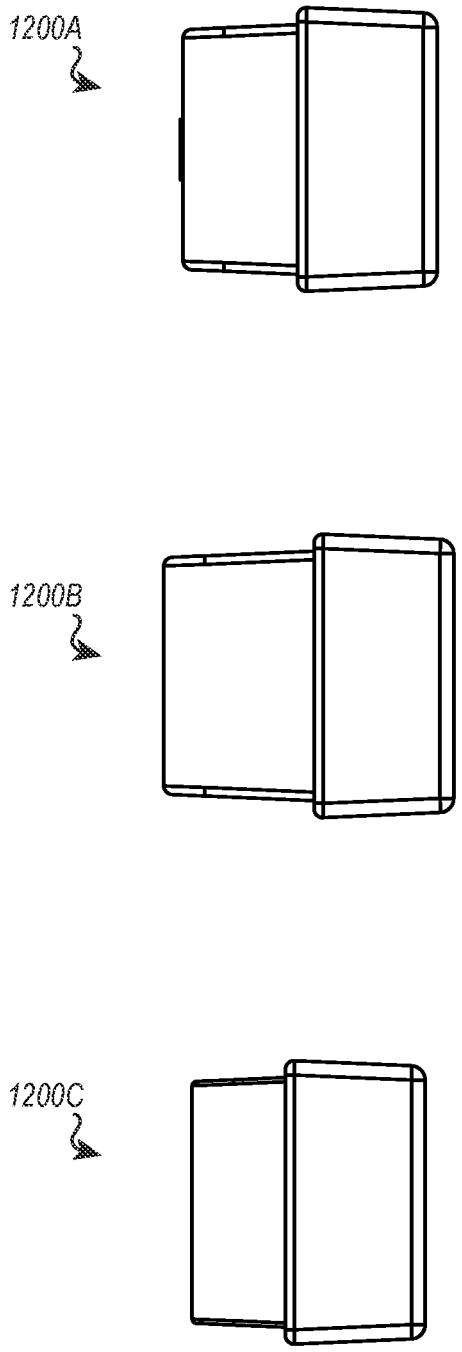
Figure 16:
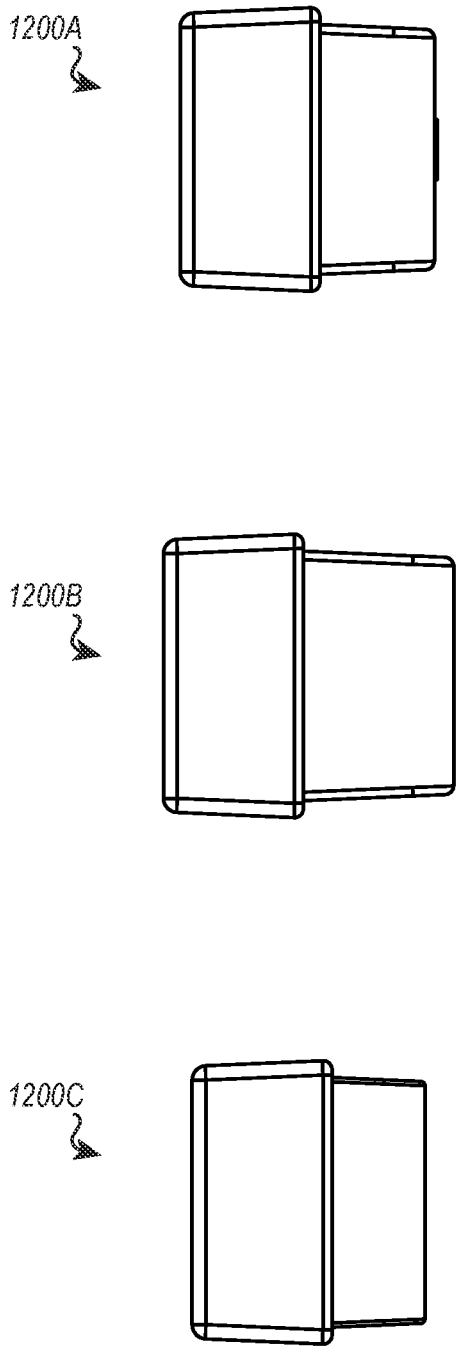

Attention will now be directed to FIG. 12, which illustrates a back top perspective view of three different wearable clips 1200A, 1200B and 1200C. These wearable clips are also referred to as wearable housings, which each contain or house a magnet (not presently shown) and which are configured to detachably secure/mount a firearm or tool (not shown) to a surface of the wearable housing(s) with magnetic force during use, with the force required to securely and detachably mount the firearm/tool to the housing being caused by the magnet (contained within the housing) interacting with ferrous material of the firearm/tool when the firearm/tool is positioned against the wearable housing during use.

Each of the illustrated wearable housings/clips 1200A, 1200B and 1200C is also configured with a detachable backing structure that forms a loop for securing the corresponding wearable clips/housing(s) to a strap, a belt, or other belt-like or strap like structure that passes through the loop formed in the backing structures, as described throughout.

In the present illustrations, each of the wearable clips or wearable housings 1200A, 1200B and 1200C is composed of a hollow body or housing 1203A, 1203B, 1203C that is substantially similar in size and shape. Each housing has a corresponding first side 1301, second side 1302, first end 1303, second end 1304 and top surface 1401 (see FIGS. 13, 14, 19 and 20).

In the current illustration, each housing 1203A, 1203B, 1203C is attached to different backing 1220A, 1220B, 1220C, respectively, that each form a loop 1230A, 1230B, 1230C, respectively, between a corresponding backing surface 1240A, 1240B, 1240C and corresponding clasping member(s) 1250A, 12506, 1250C. Each loop 1230A, 12306, 1230C, having different width and length dimensions, as will be discussed more below, to accommodate different types of belts, straps or other similar structures that will pass through the loop(s) when mounting the wearable housing(s) 1200A, 12006, 1200C to the straps, belts or other similar structures.

Each of the backings 1220A, 12206 is also configured with mounting features 1251 (comprising holes) for accommodating and receiving a screw 1252 that affixes to and secures a sizing block 1260A and 12606 within the loops 1230A, 12306 of the corresponding backings 1220A and 12206, respectively. These sizing blocks can be moved to different positions within the loops 1230A, 12306 to change the length of the loops 1230A, 12306, respectively, to accommodate different widths of the straps/belts that are positioned within the loops.

Figure 19:
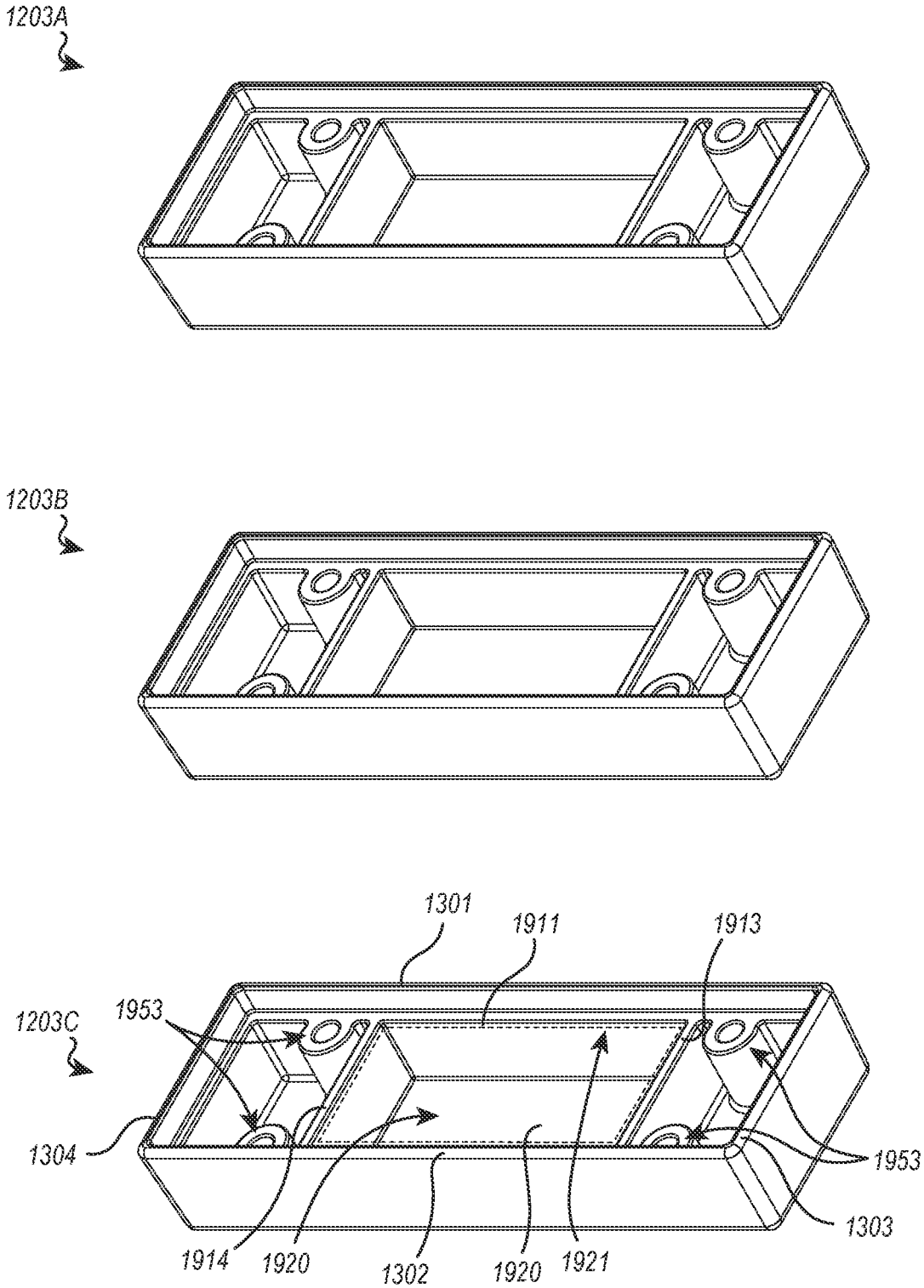
FIGS. 19-25 illustrate corresponding back top perspective views (FIG. 19), bottom views (FIG. 20), top views (FIG. 21), frontside views (FIG. 22), backside views (FIG. 23), right side views (FIG. 24), and left side views (FIG. 25), respectively, of the different housings for the wearable clips or housings shown in FIGS. 12-18.

Additional mounting features 1253 (e.g., holes-threaded or unthreaded) are also formed into each of the backings 1220A, 12206, 1220C, to receive screws 1254 that detachably/threadedly mount each of the different backings to the same and/or different housings via matching mounting features 1953 in the housings (see FIG. 19, wherein the mounting features 1953 comprise threaded holes in the housings).

FIGS. 13-18 illustrate corresponding bottom views (FIG. 13), top views (FIG. 14), frontside views (FIG. 15), backside views (FIG. 16), right side views (FIG. 17), and left side views (FIG. 18), respectively, of the different wearable housings 1200A, 12006, 1220C, that each has a similarly configured housing 1203A, 1203B, 1203C attached to a differently configured backing (i.e., backings 1220A, 12206 and 1220C) shown in FIG. 12.

Figure 17:
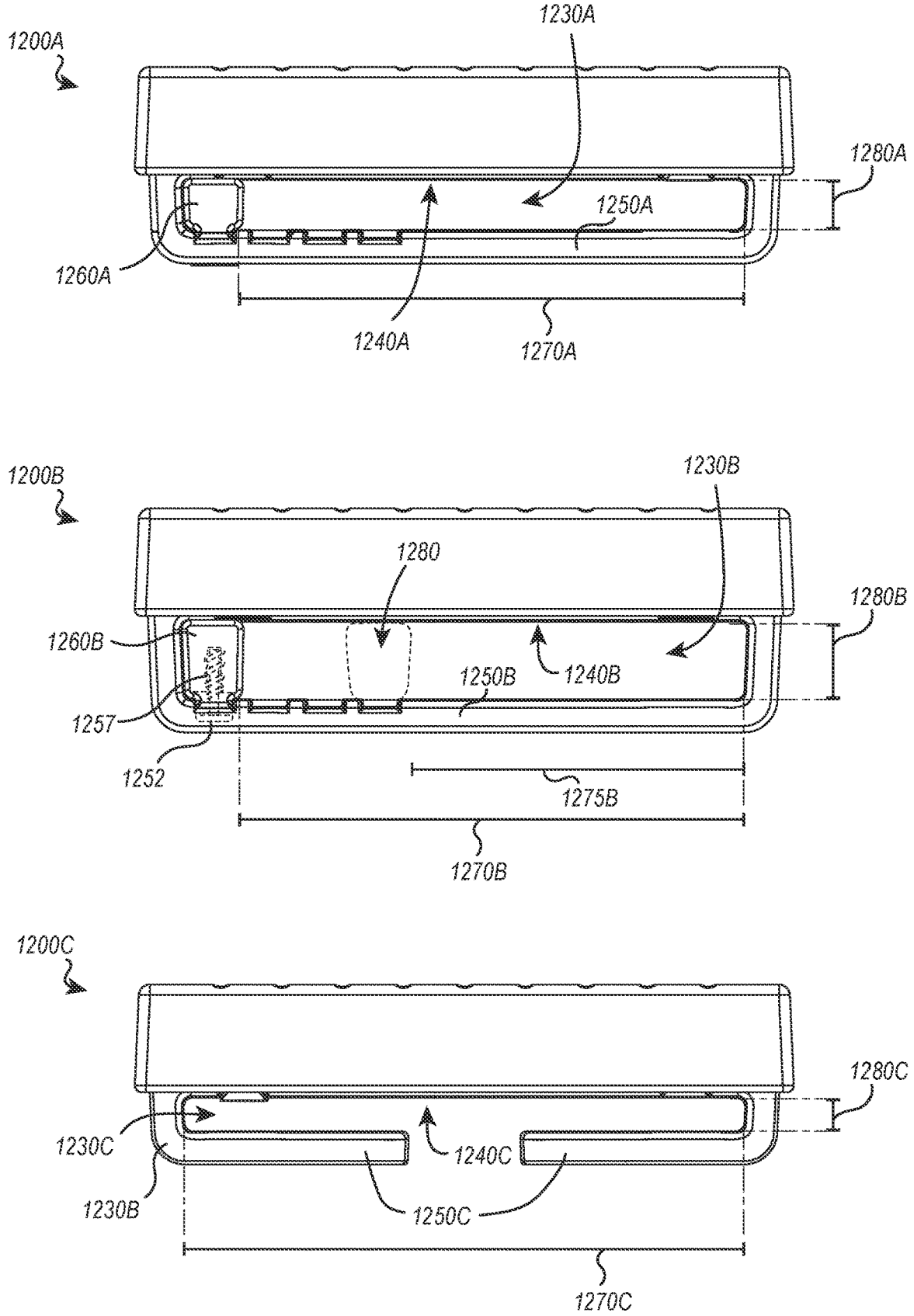
Figure 18:
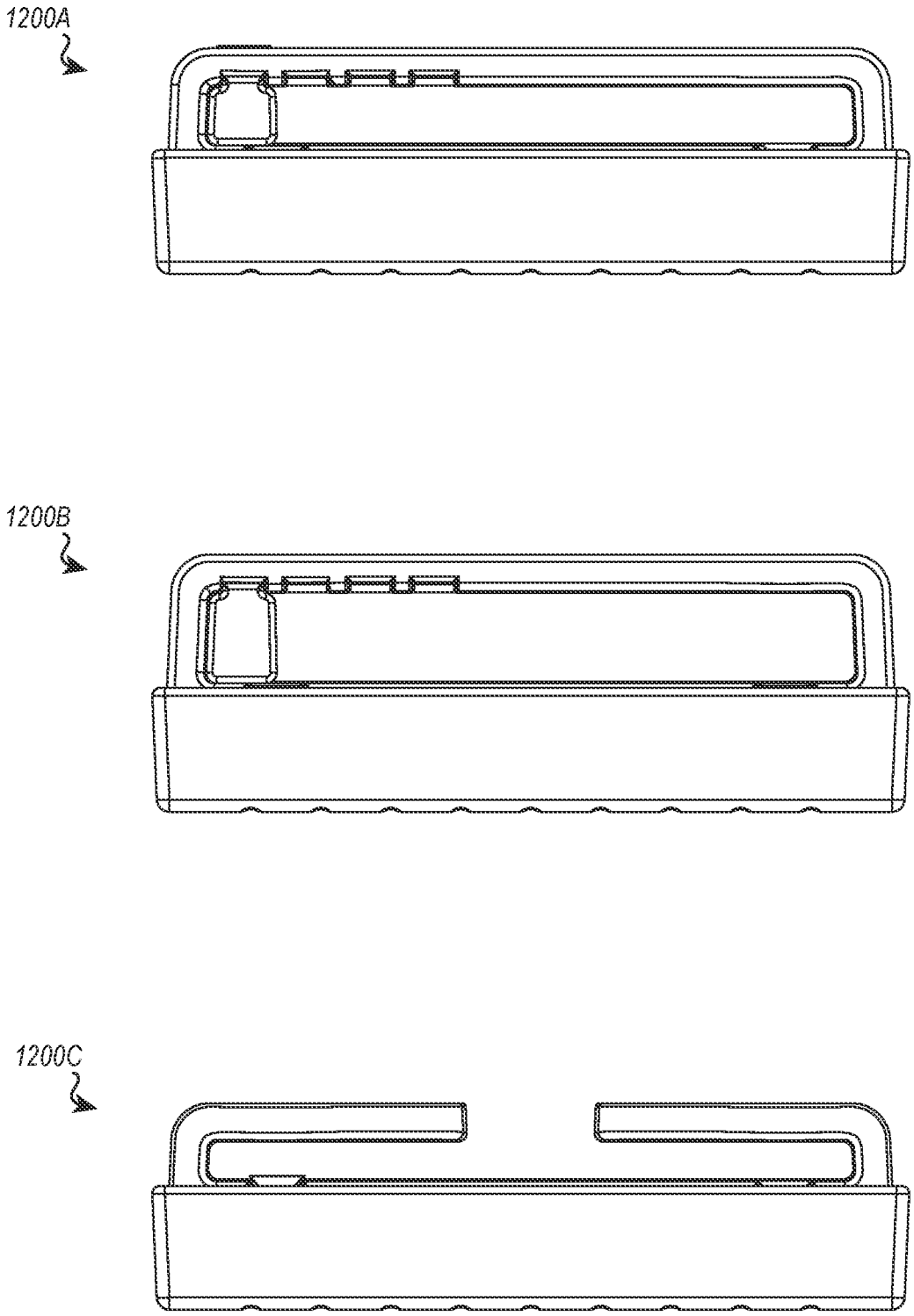

Attention will be directed specifically to FIG. 17 to provide additional clarification on the differently configured loops 1230A, 1230B and 1230C, each loop having a corresponding length (e.g., 1270A, 1270B and 1270C, respectively) and width (e.g., 1280A, 1280B and 1280C, respectively).

In some embodiments, the loop length is within a range of about 2.0 inches and 3.0 inches. In some embodiments, the loop has a length or about 2.75 inches and/or within a range of about 2.6 and 2.8 inches.

The loops also preferably have a width within a range of about 0.20 inches and 0.40 inches. In some embodiments, the loop has a width of about 0.225 inches. In another embodiment, the loop has a width of about 0.35 inches.

Notably, the loop lengths 1270A and 1270B can also be modified, in part, by the existence and positions of the sizing blocks 1260A and 1260B within the loops, respectively. These sizing blocks 1260A and 1260B are secured in place, within the loops, by a screw 1252 that passes through mounting features in the clasping members of the wearable housings 1200A and 1200B, respectively, and that threads into each of the different sizing blocks 1260A and 1260B, respectively (even though the threading is only presently shown for sizing block 1260B).

To change the length of a loop, such as to change the length 1270B of loop 1230B to length 1275B, a user can move the sizing block 1260B to a different position in the loop 1230B, such as to position 1280. The sizing block 1260B can be secured in this position by threading the screw 1252 into the sizing block 1260B through the mounting feature (hole) shown at position 1280.

When the loop length is modified from a spacing block to length 1275B, for example, the effective loop length (in the area where the belt/strap goes) between a spacing block and the clasping member on the other side of the loop, may be restricted to less than 2 inches and in some instances to as little as 1.5 or 1 inch. In some instances, each adjustment of the spacing block along the clasping member will change the dimensions of the loop by about 0.25 inches. More particularly, the spacing between each of the holes 1251 is about 0.25 inches. However, in other embodiments, the spacing between the holes and the corresponding adjustment to the loop length made by moving the spacing block between adjacent holes can be less than 0.25 inches or more than 0.25 inches to accommodate different needs and preferences. Likewise, the holes can be spaced along only one half of the backing/along the clasping member in some embodiments. Or, alternatively, the holes can be spaced along the entire backing of the interchangeable back, to accommodate different needs and preferences.

It is noted that although backing 1220C does not presently show mounting features 1251 for accommodating a sizing block (e.g., 1260A or 1260B), in some embodiments, the backing 1220C is further configured with holes or other mounting features 1251 in either or both of the clasping members 1250C, similar to those formed in backing 1220A and 12206, to accommodate and secure a sizing block in different positions and to provide a variable/selectable length for the loop 1230C to accommodate secure attachment of the wearable clip 1200C to differently sized straps/belts.

It is noted that loops 1230A and 12308 are formed as closed loops, between the back surfaces 1240A and 12408 and the corresponding clasping members 1250A and 12508 of the backings 1220A and 12208, respectively. In an alternative configuration, loop 1230C comprises an open loop 1230C formed between the back surface 1240C and the opposing clasping members 1250C of the corresponding backing 1220C.

It will be appreciated that the different sized loops (having different widths and variable lengths) are beneficial to accommodate different types of straps, belts or other structures and their corresponding widths and lengths. It will also be appreciated that it is possible to interchange the different backings 1220A, 12208 and 1220C on a single housing (e.g., 1230A), when desired, to enable the securing of the wearable housing/clip 1200A, 12008 and/or 1200C to differently sized belts and straps.

To switch the backings, a user only needs to unscrew and screw in the screws holding the backing(s) to the housing (e.g., via threaded holes 1953). This interchangeability of backings is beneficial for reducing costs, such that a user can buy a kit comprising a single housing 1230A, with two or more different backings (e.g., 1220A, 12208 and/or 1220C) and select the backing that is desired at any time.

FIGS. 19-25 illustrate corresponding back top perspective views (FIG. 19), bottom views (FIG. 20), top views (FIG. 21), frontside views (FIG. 22), backside views (FIG. 23), right side views (FIG. 24), and left side views (FIG. 25) of the different housings 1203A, 1203B and 1203C for the corresponding different wearable housing/clips 1200A, 12008 and 1200C, respectively, shown in FIGS. 12-18.

Figure 20:
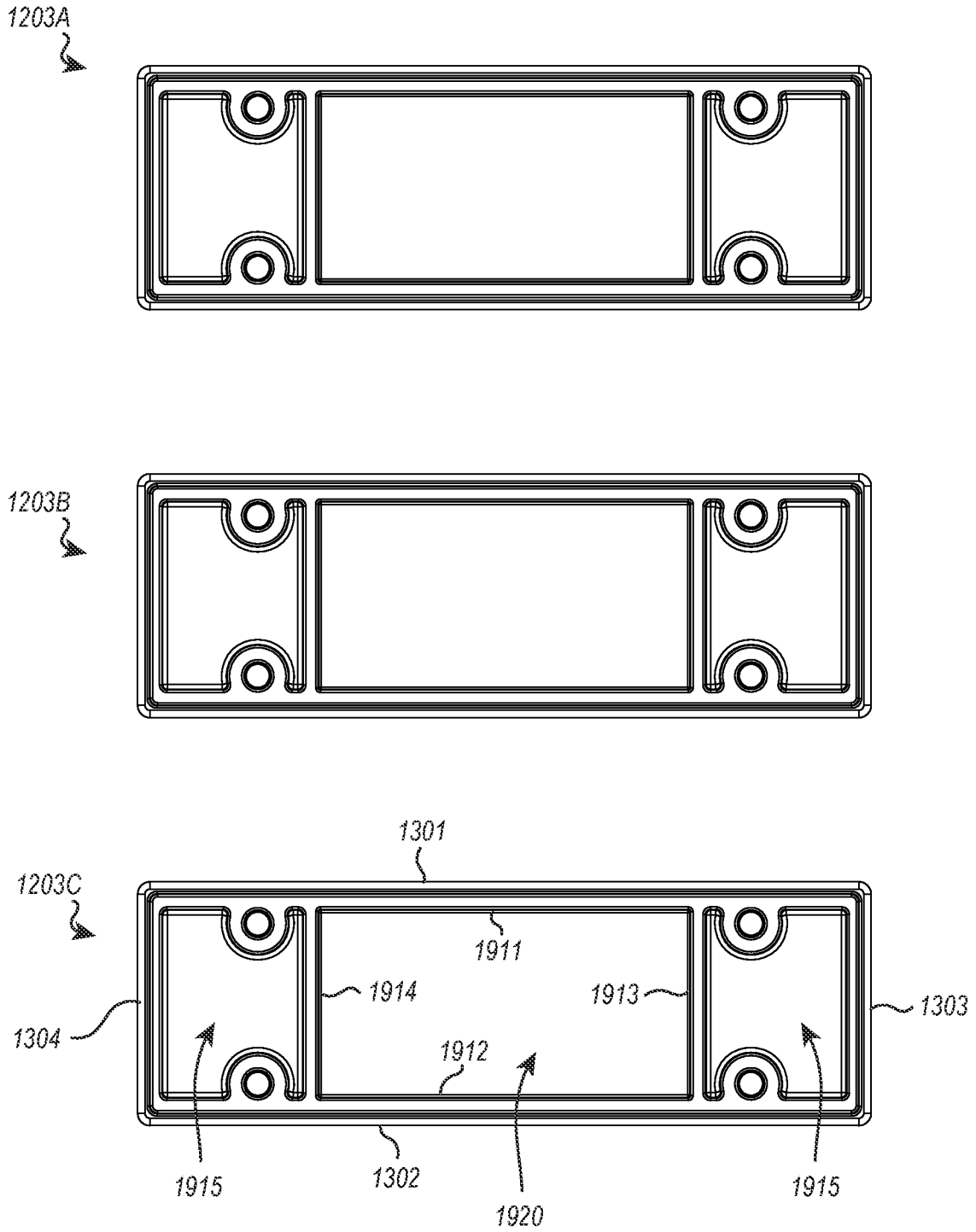
Figure 21:
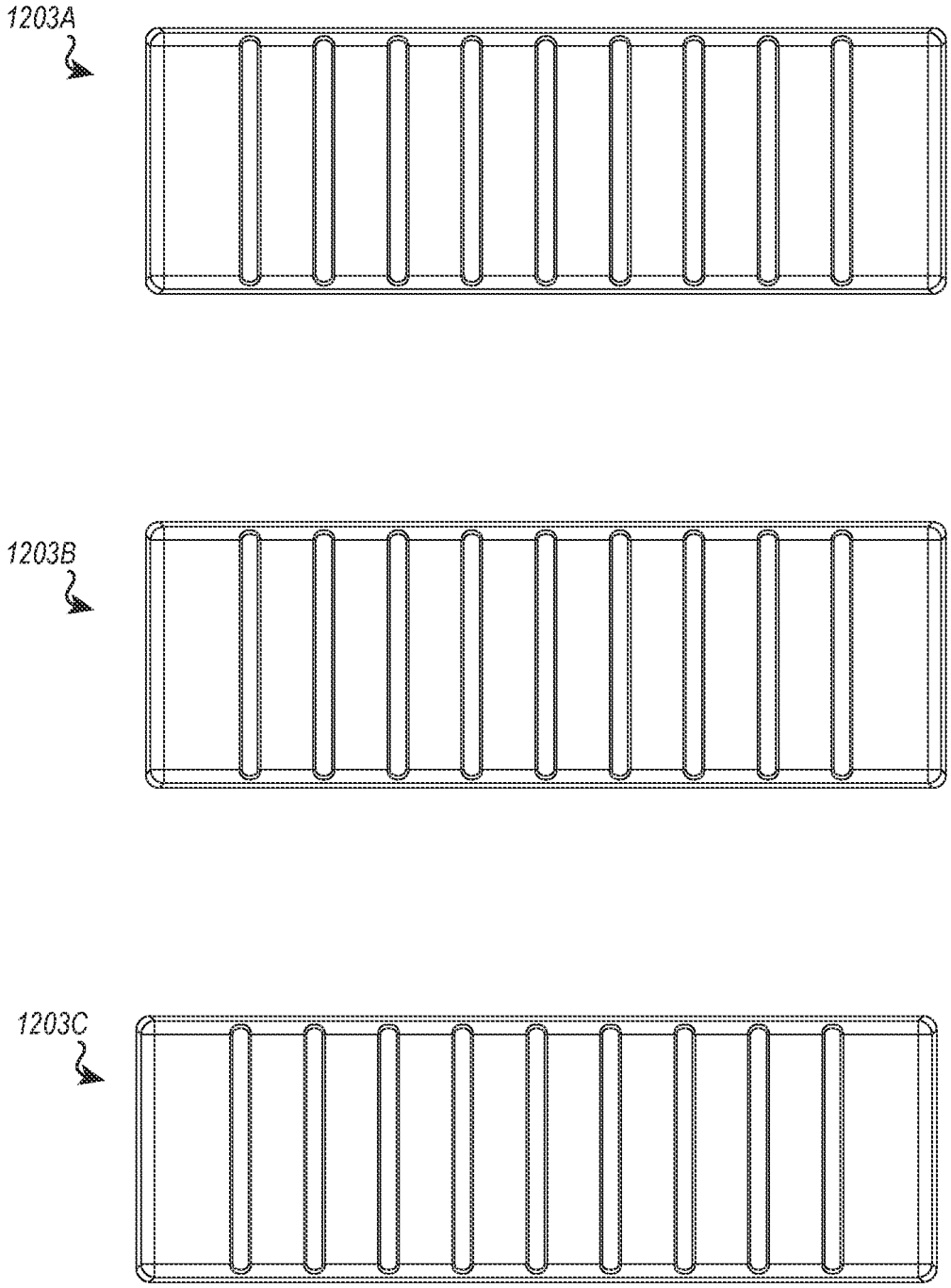
Figure 22:
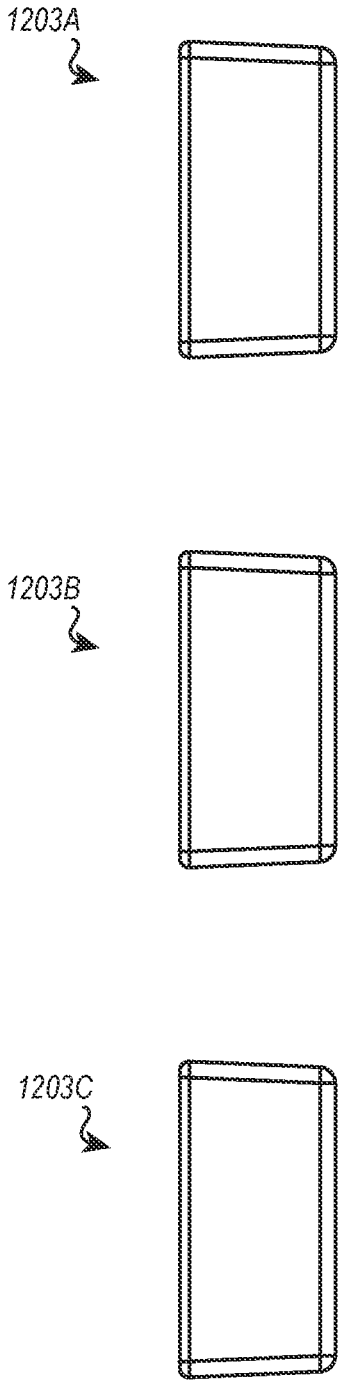
Figure 23:
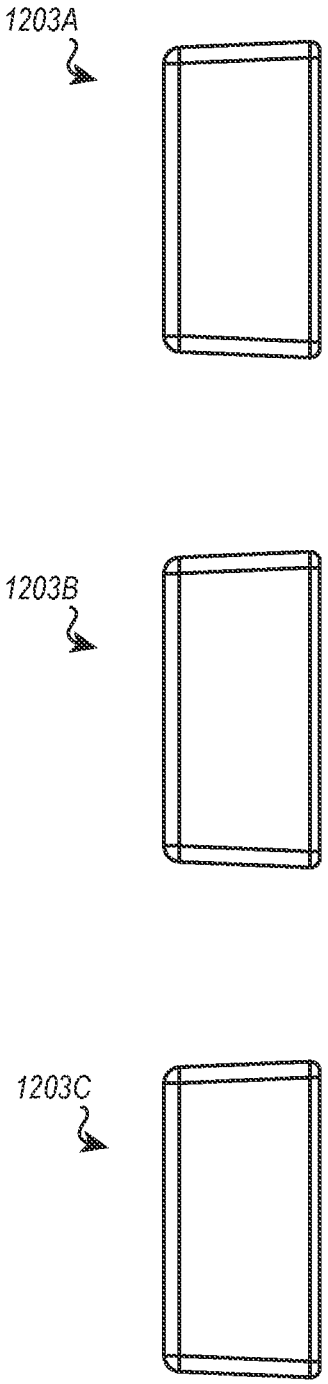
Figure 24:
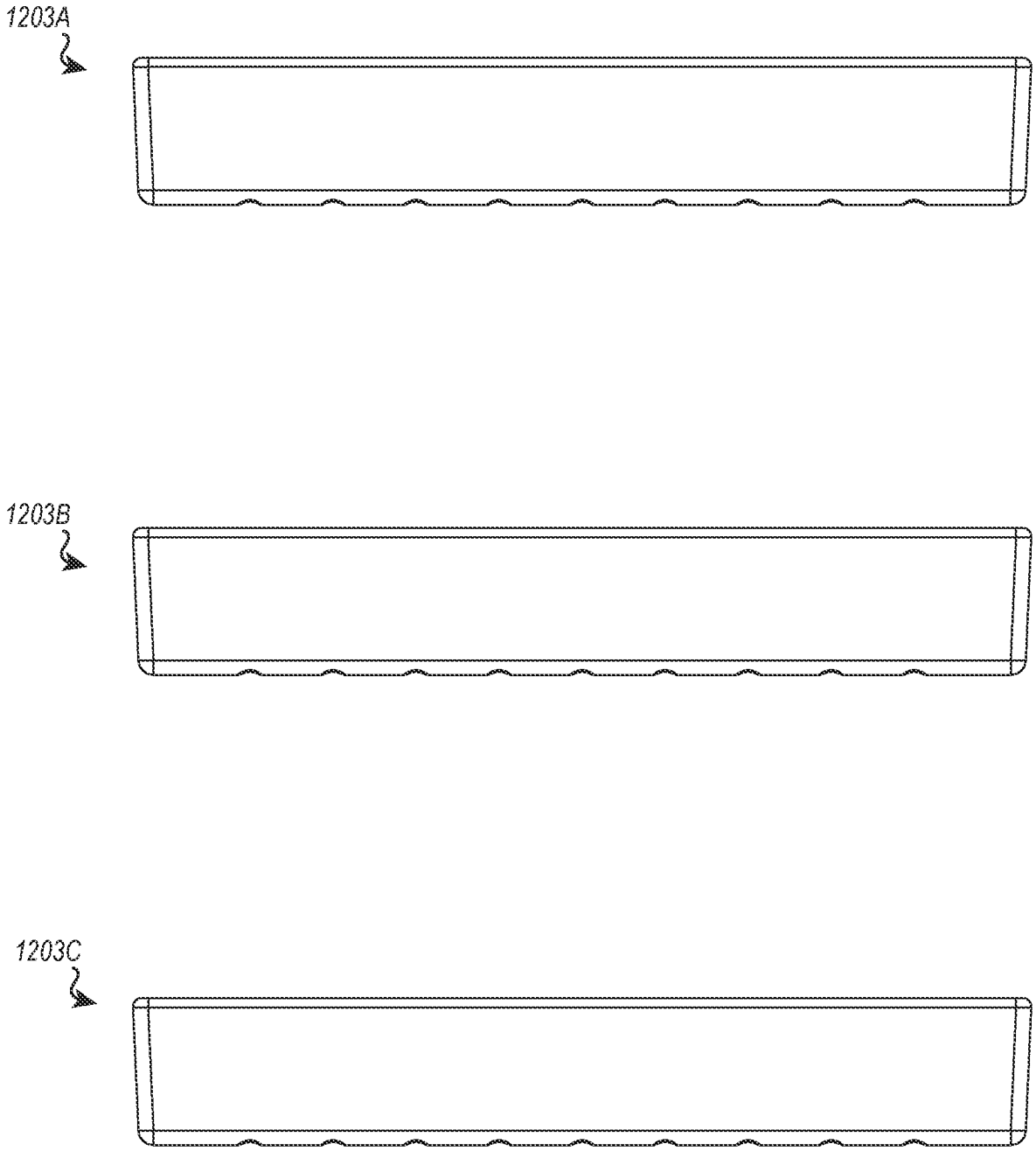
Figure 25:
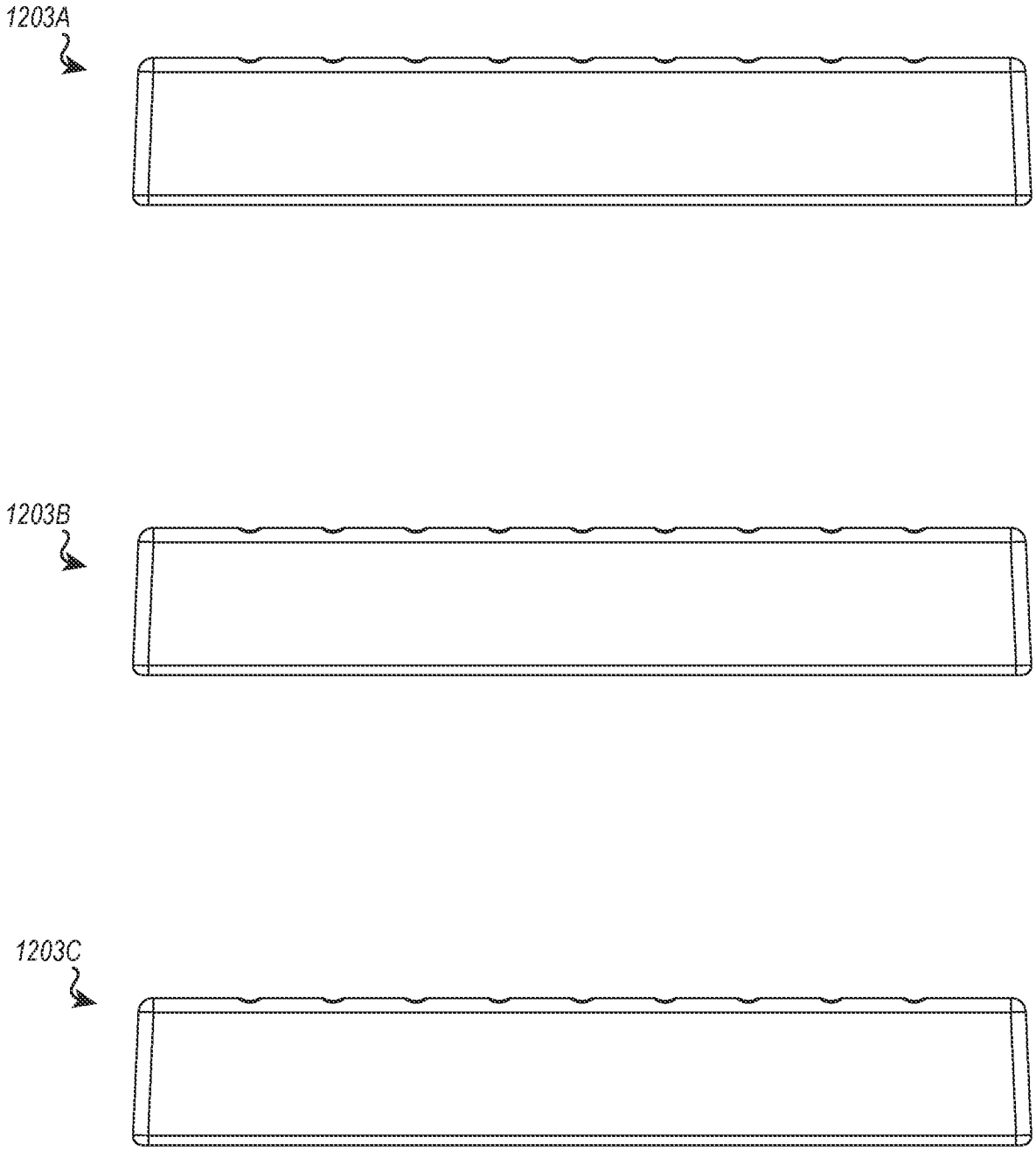
Figure 26:
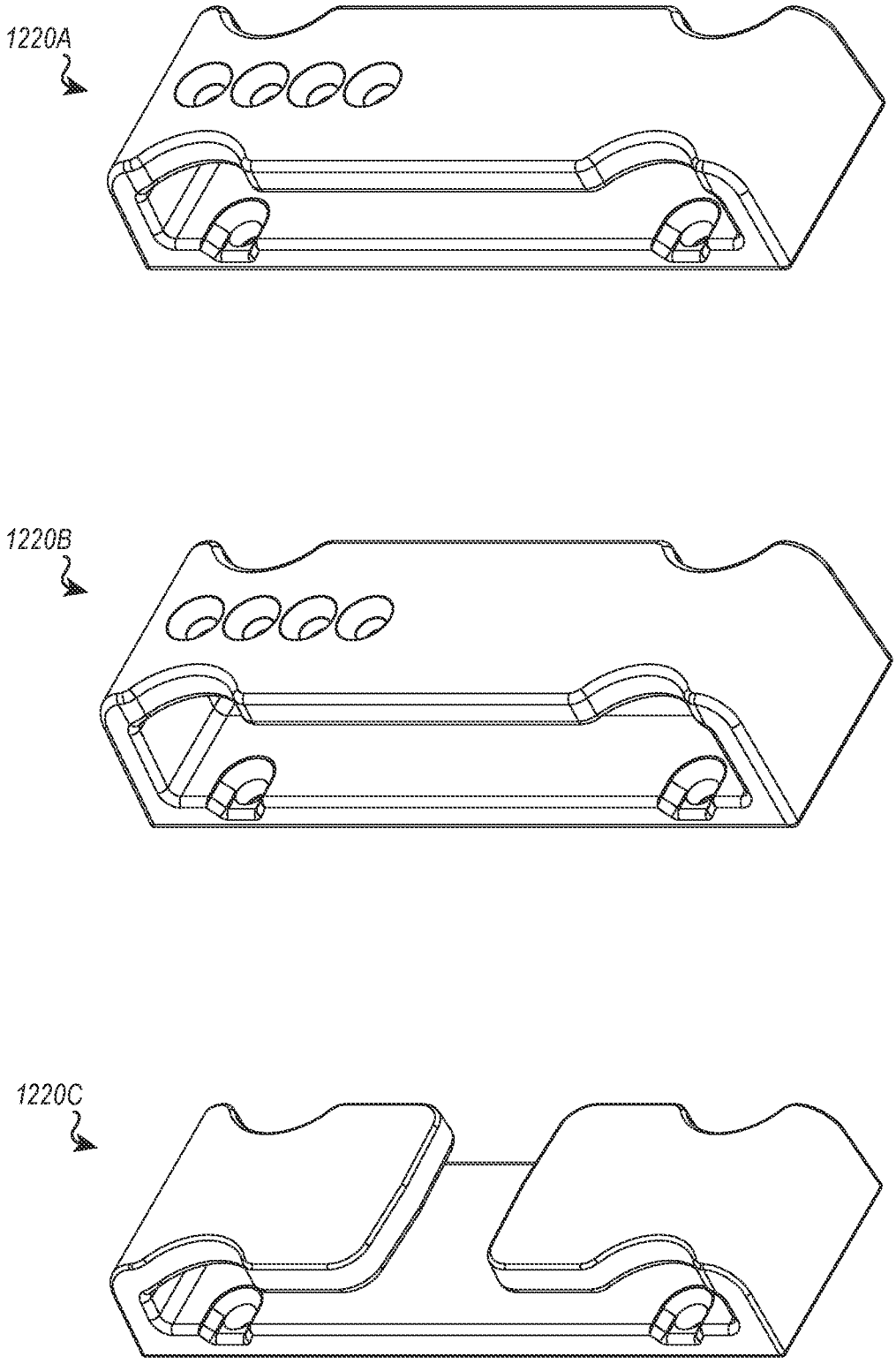
FIGS. 26-32 illustrate corresponding back top perspective views (FIG. 26), bottom views (FIG. 27), top views (FIG. 28), frontside views (FIG. 29), backside views (FIG. 30), cutaway right side views (FIG. 31), and cutaway left side views (FIG. 32), respectively, of the differently configured backings for the wearable housings shown in FIGS. 12-18.
Figure 27:
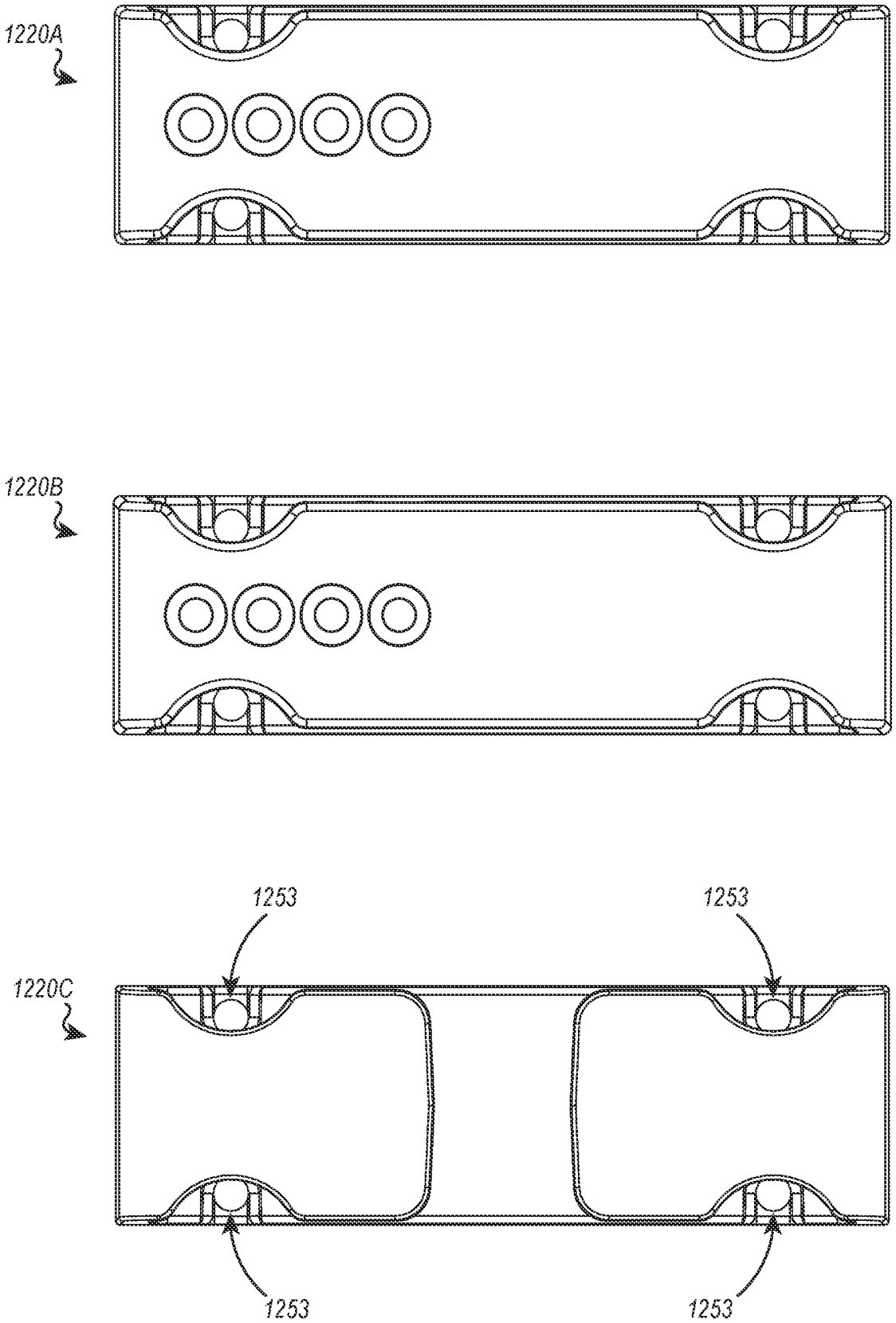
Figure 28:
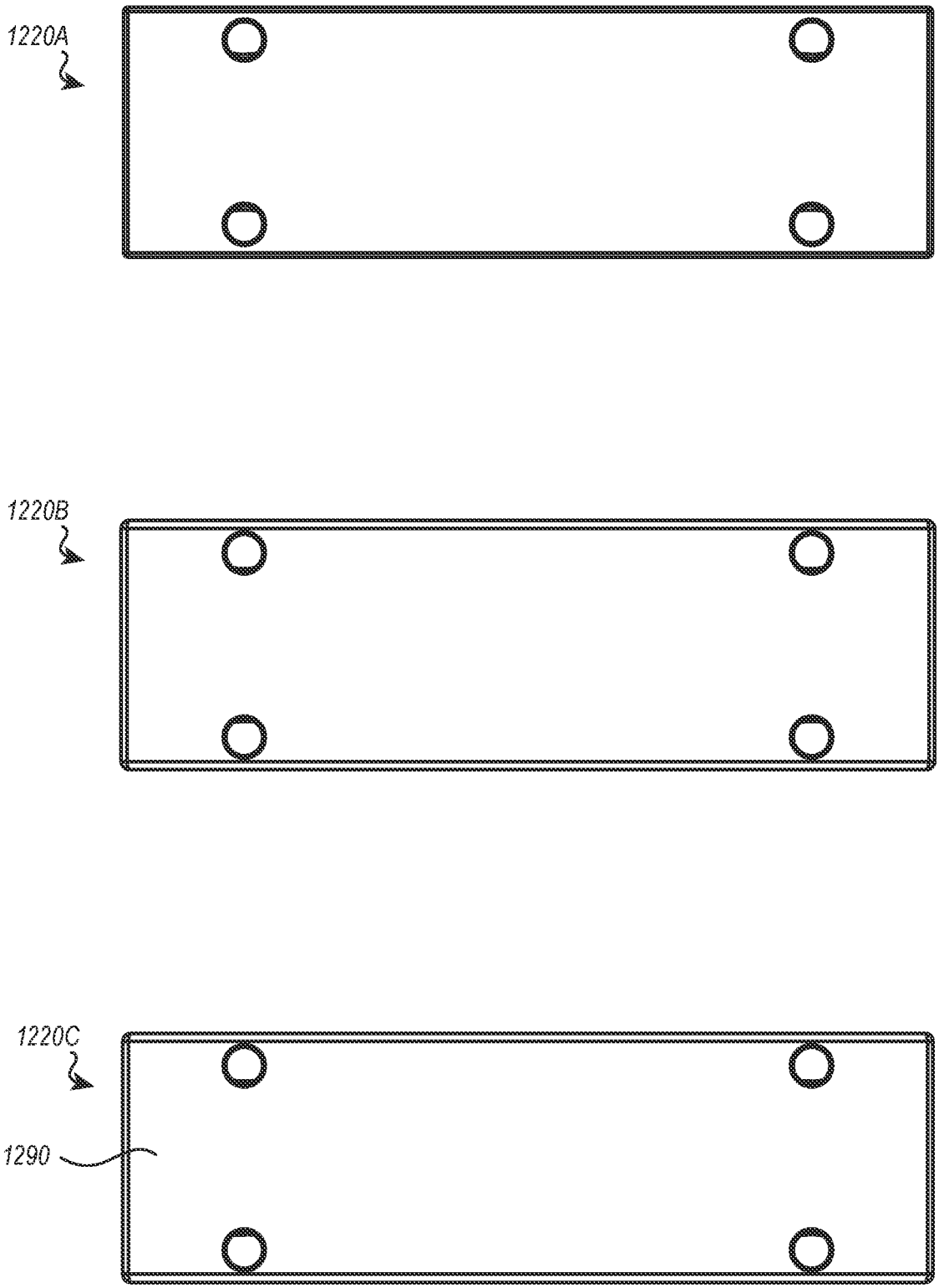
Figure 29:
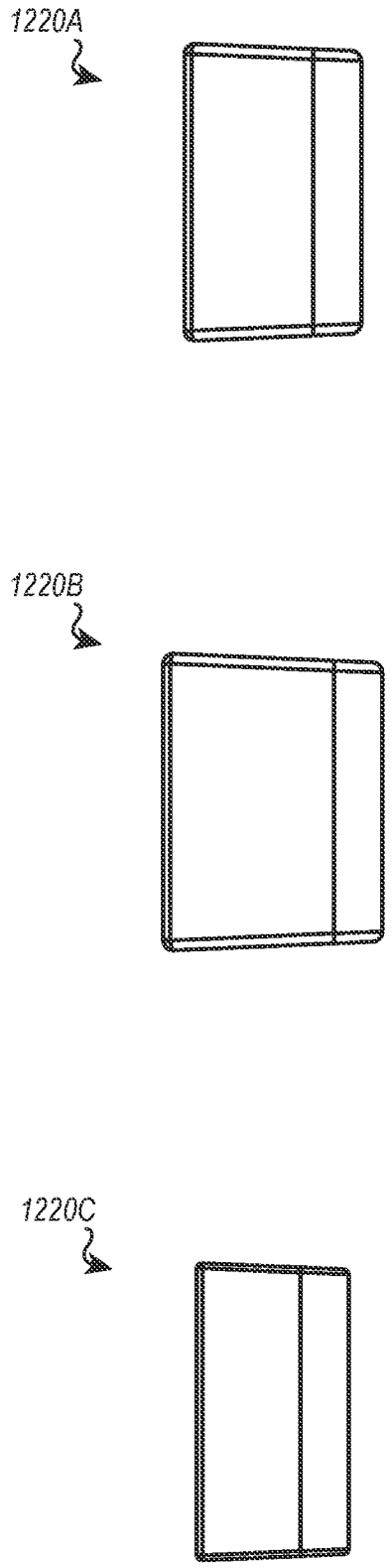
Figure 30:
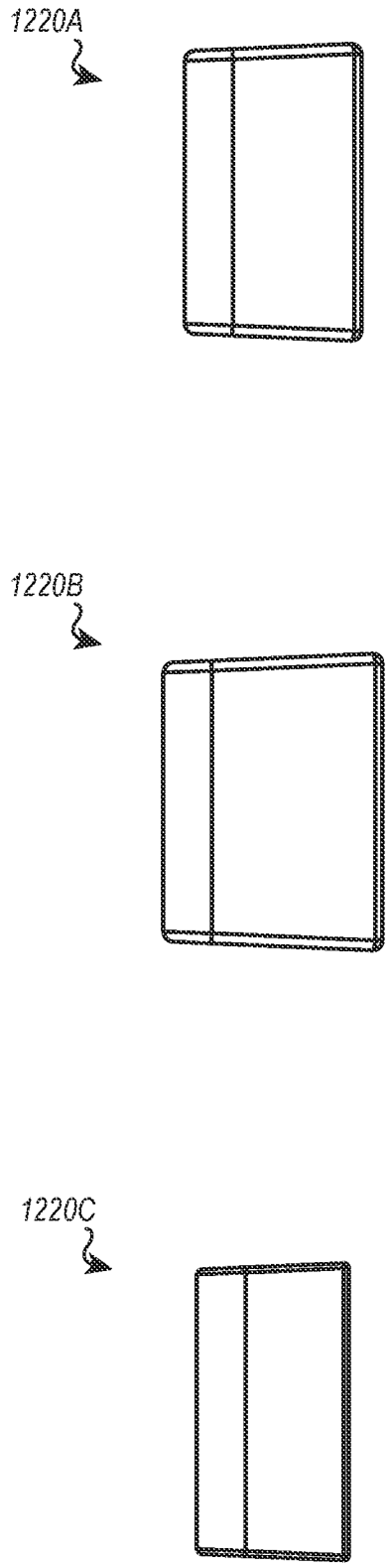
Figure 31:
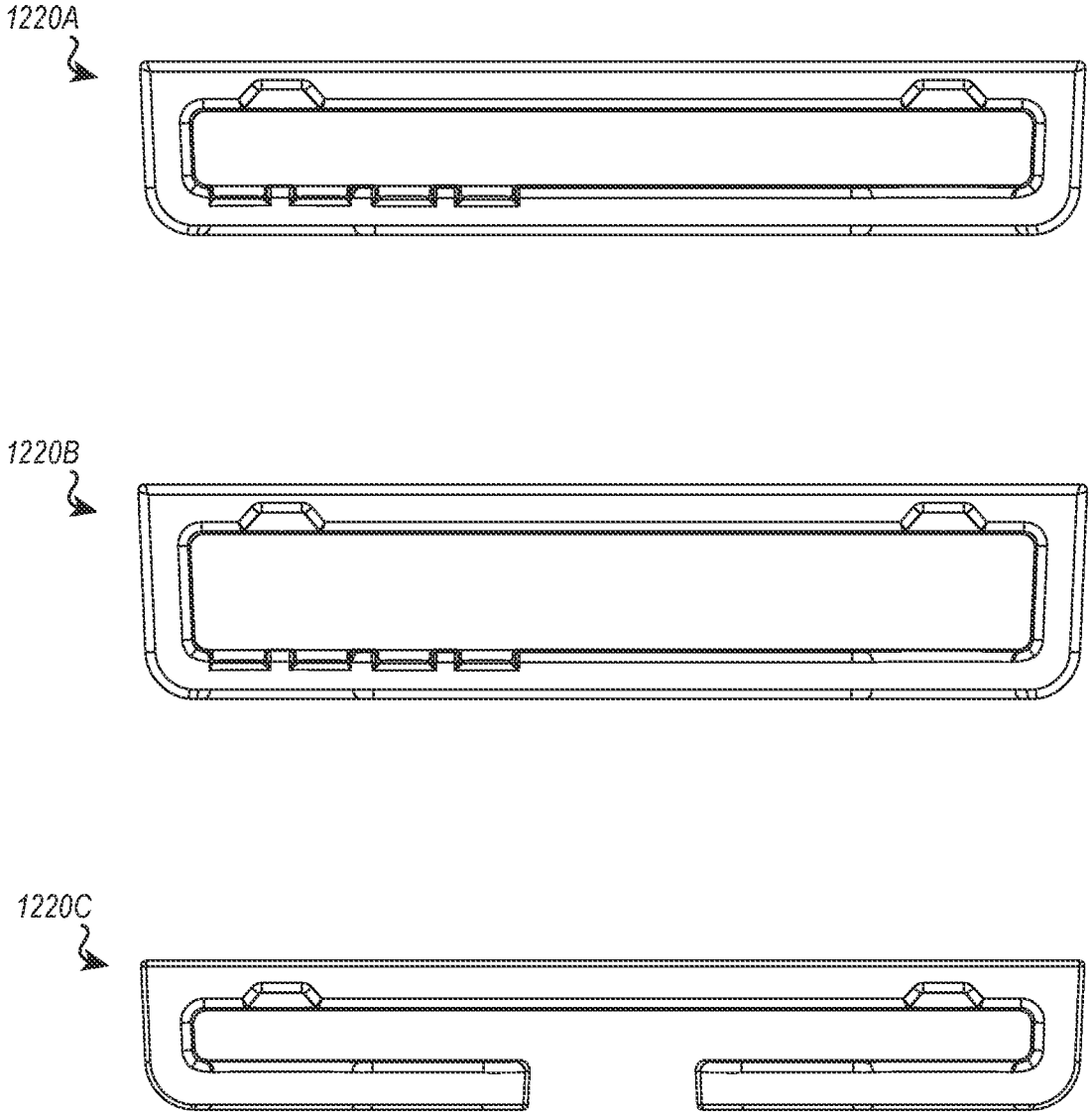
Figure 32:
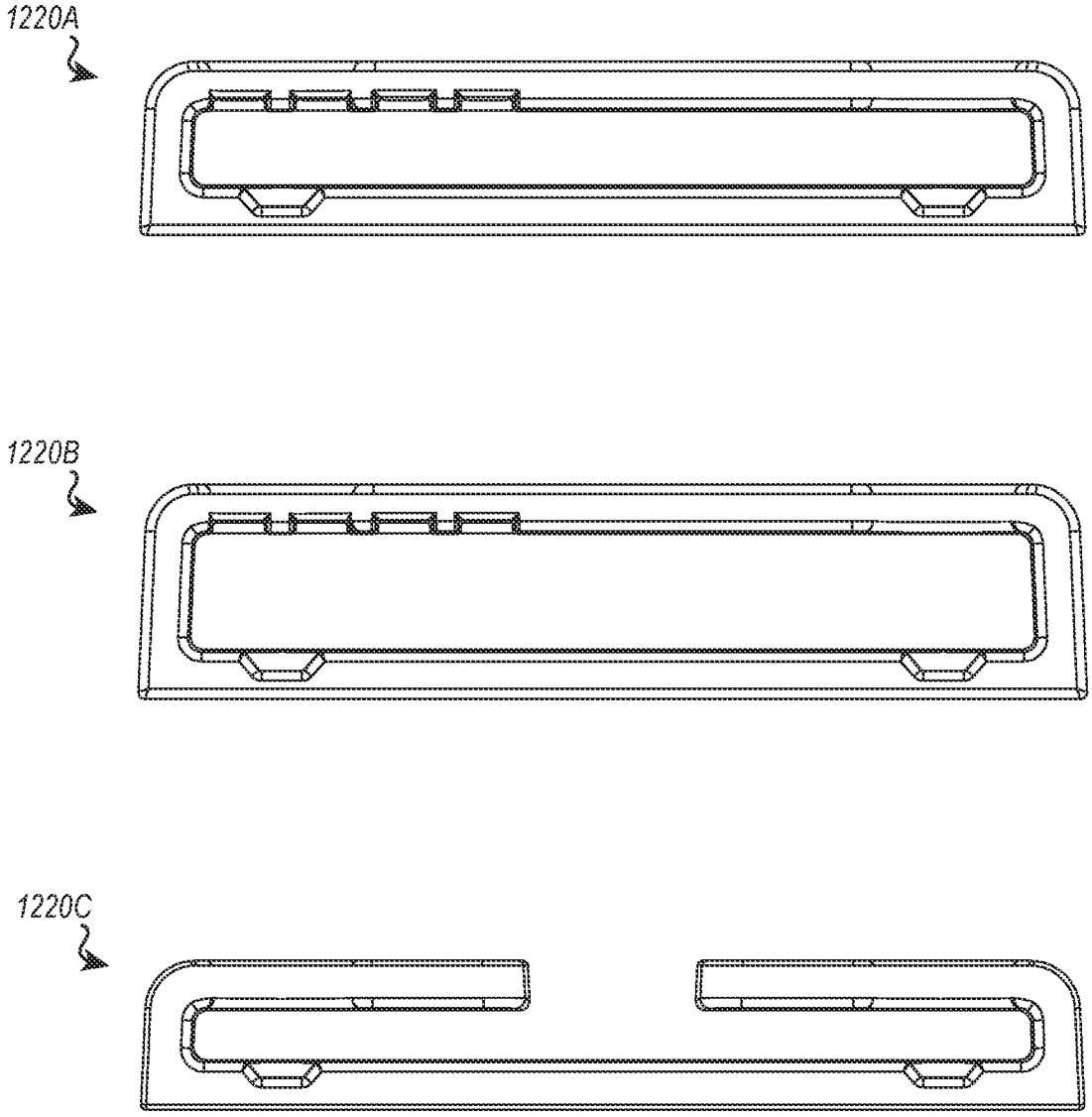

It is noted, with regard to the reference numbers shown in FIGS. 19-20, that the interior receptacle that is formed inside of the housing 1203C (and 1203B and 1203A) between walls 1301, 1302, 1303 and 1304 may be separated into discrete and separate chambers (e.g., interior receptacle 1920, and chambers 1915) that are individually separated by additional walls of the housing (e.g., walls 1913 and 1914).

It is also noted that the interior receptacle may be sized to accommodate a magnet (e.g., magnet 1020 of FIG. 10B, or another magnet) of a similar dimensional size (e.g., length, width, depth) that is placed within the interior receptacle 1920. Such a magnet may occupy the space/dimensions that is currently reflected by a dashed line 1921 within interior chamber or receptacle 1920.

The width and length of the magnet, not presently shown, may be similar to, or the same as, the width and length of the interior receptacle 1920, to form a friction fit between the magnet and the interior sidewalls (1911, 1912, 1913 and 1914) of the interior receptacle 1920. The length of the interior receptacle 1920 is the space existing between interior sidewalls 1913 and 1914, whereas the width of the interior receptacle 1920 is the space existing between the interior sidewalls 1911 and 1912.

FIGS. 26-32 illustrate corresponding back top perspective views (FIG. 26), bottom views (FIG. 27), top views (FIG. 28), frontside views (FIG. 29), backside views (FIG. 30), right side views (FIG. 31), and left side views (FIG. 32) of the replaceable backings 1220A, 1220B, 1220C of the different wearable housings 1200A, 1200B, 1200C, respectively, shown in FIGS. 12-18. Notably, the mounting features 1253 (e.g., holes-threaded or unthreaded, but which are presently only illustrated as unthreaded), which were described in FIG. 12, are more visible in FIG. 27.

FIGS. 33-38 show additional embodiments of alternative configurations of housings (i.e., housing 3300), and interchangeable backings 3400, 3500, 3600 and spacing blocks 3700 and 3800.

Figure 33:
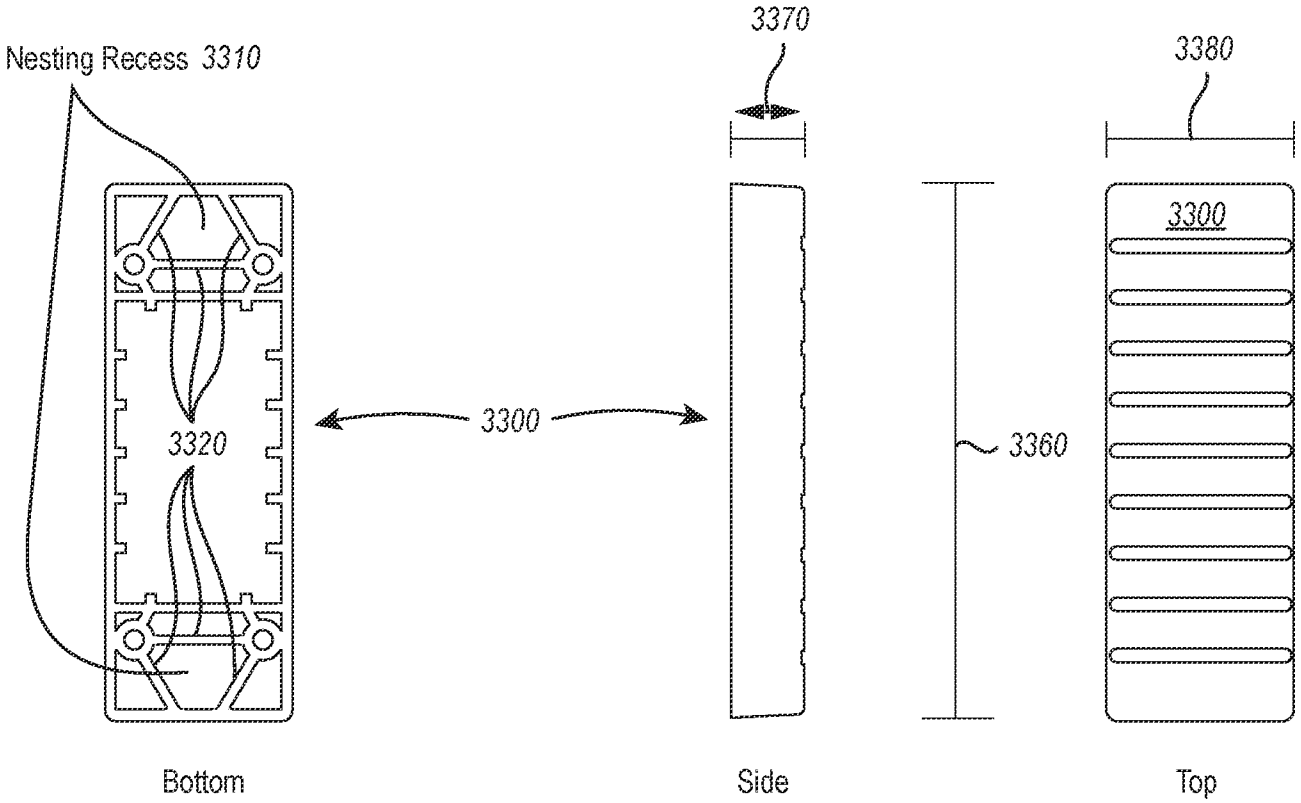
FIGS. 33-38 show additional embodiments of the wearable housings, and which include different components, such as a base component (FIG. 33) and corresponding and interchangeable backing structures, also referred to herein as clips (FIGS. 34-36) with clasping members, and sizing blocks, also referred to herein as belt blocks (FIGS. 37-38).

FIG. 33 shows top, side and bottom views of a housing 3300 that can be connected to different interchangeable backings (as described above) and which may include, for example, interchangeable backings 3400, 3500, 3600 or any of the other interchangeable backings described herein (e.g., 1220A, 1220B, 1220C).

Housing 3300 includes nesting recesses 3310 that are formed into the substantially hollow interior receptacle/chamber of the housing 3300 by additional wall structures 3320 that are positioned within the interior of the housing 3300. This embodiment is similar to the embodiment described and shown in FIGS. 19-20, but wherein the nesting recesses 3100 are further formed into the additional chambers 1915 of the housing.

The length 3360 of the housing can vary to accommodate different needs and preferences and may be within a range of about 2.5 inches to about 3.5 inches. In some embodiments, the length is about 2.85 inches and/or within a range of about 2.75 inches and 3.0 inches.

The height 3370 of the housing can vary to accommodate different needs and preferences and may be within a range of about 0.4 inches to about 0.7 In some embodiments, the height is about 0.45 inches. In other embodiments, the height is about 0.525 inches. embodiments, the height is about 0.65 inches.

The width 3380 of the housing can vary to accommodate different needs and preferences and may be within a range of about 0.75 inches to about 1.25 In some embodiments, the width is about 1 inch.

Figure 34:
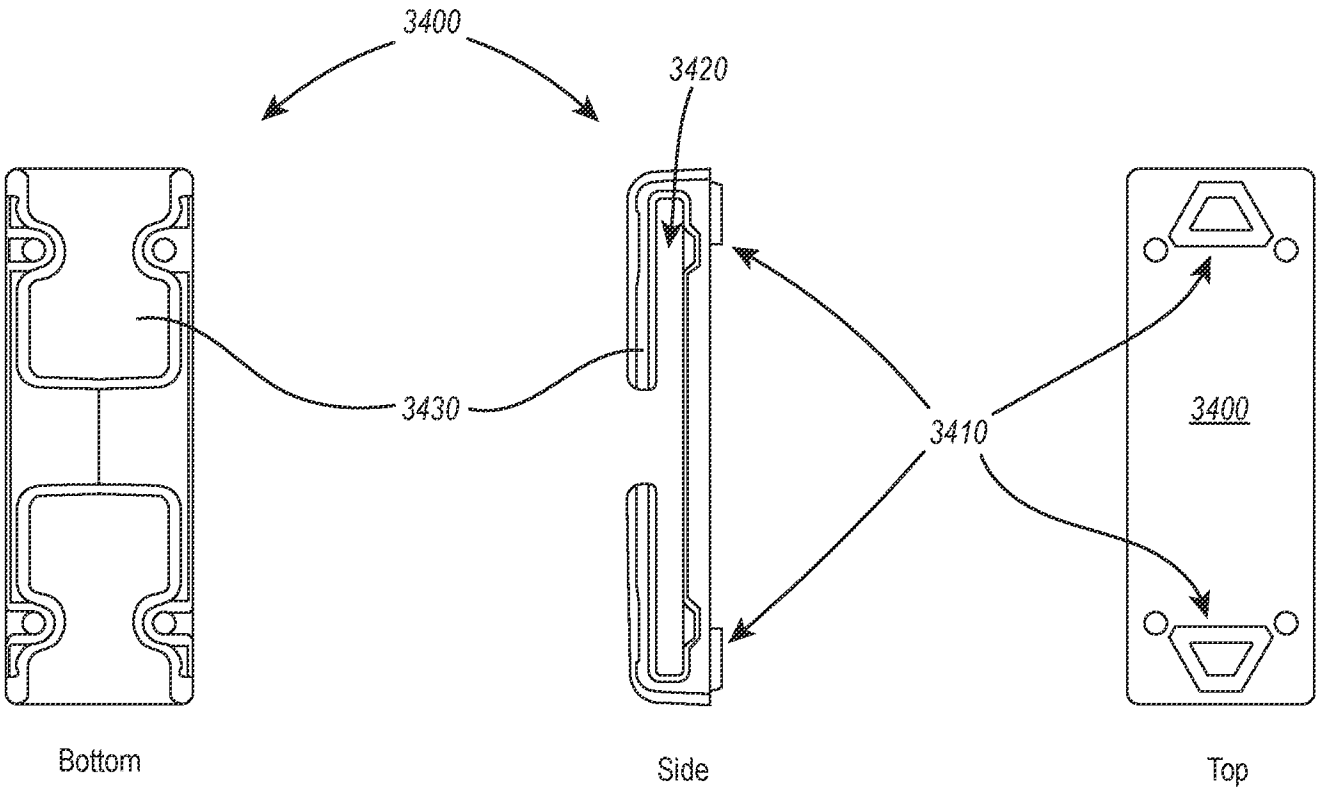

FIG. 34 illustrates top, side and bottom views of an interchangeable backing 3400 that can be connected to different housings (as described above) and which may include, for example, housing 3300 or any of the other housings described herein (e.g., 1203A, 1203B, 1203C).

Housing 3300 includes nesting structures 3410 that are configured to mate with and frictionally engage corresponding nesting recesses formed within an attached housing, when the interchangeable backing is connected to said housing, (e.g., by inserting nesting structures 3410 into nesting recesses 3310 of housing 3300, for example).

Figure 35:
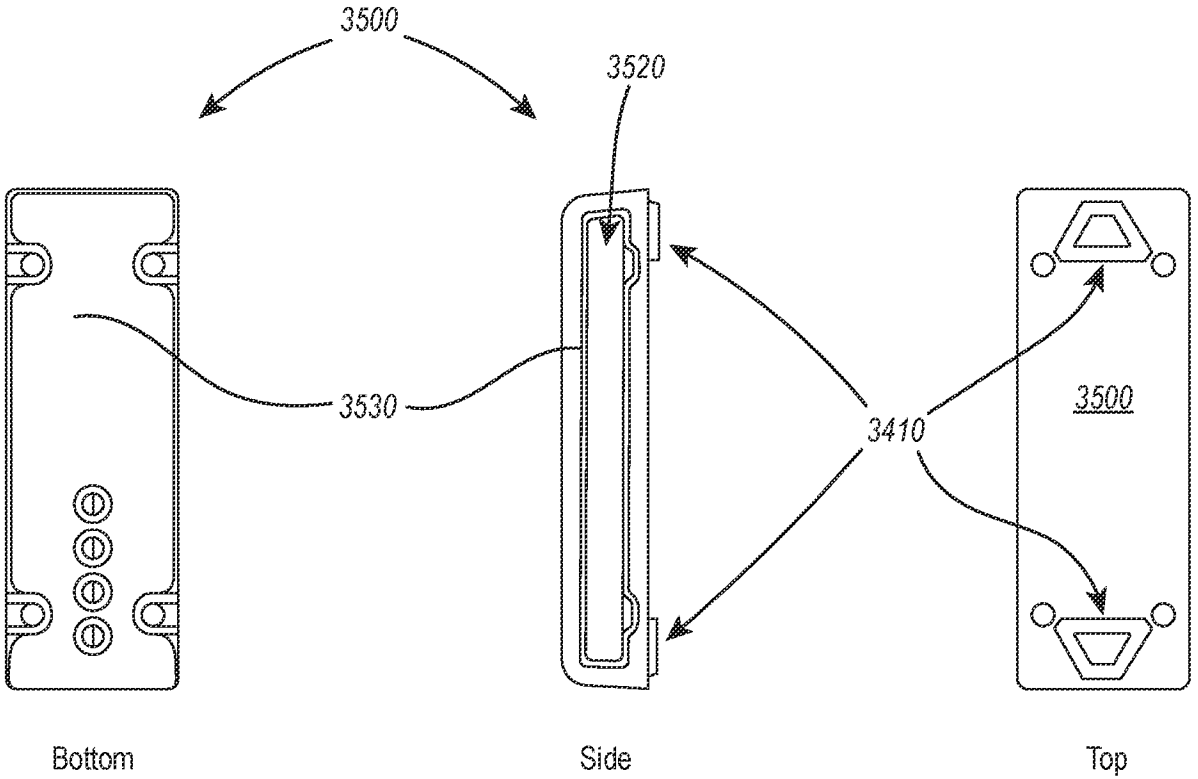
Figure 36:
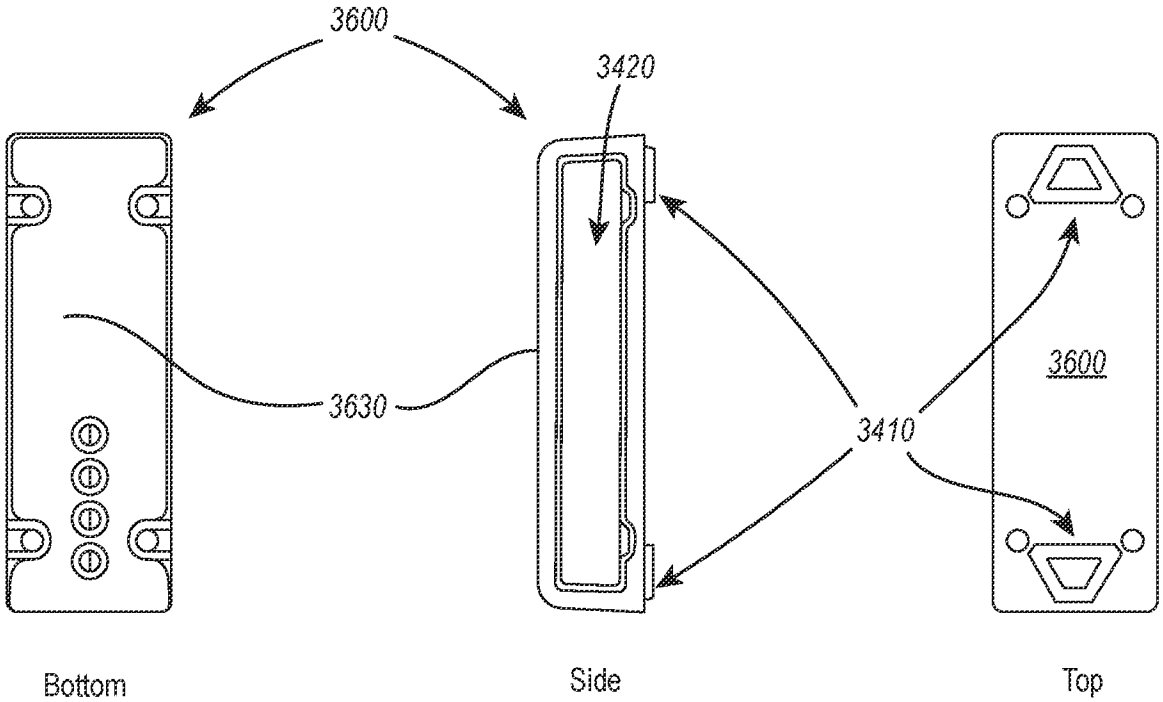

FIGS. 35 and 36 illustrate additional interchangeable backings (3500, 3600, respectively), which are similar to the interchangeable backing 3400, but wherein interchangeable backings 3400, 3500 and 3600 each incorporate different configurations of clasping members (3430, 3530, 3630) for forming differently configured and sized loops (3420, 3520, 3620).

The clasping members and loops of interchangeable backings 3400 are similar to the configurations of corresponding clasping members and loops described in reference to the interchangeable backing 1200C, while clasping members and loops of interchangeable backings 3500 are similar to the configurations of corresponding clasping members and loops described in reference to the interchangeable backing 1200A, and while the clasping members and loops of interchangeable backings 3600 are similar to the configurations of corresponding clasping members and loops described in reference to the interchangeable backing 1200A. These various configurations, which are only illustrative, and not limiting, show how the widths and lengths of the different loops can be varied to accommodate different needs and preferences (e.g., to securely attach to different sized belts/straps).

In some embodiments, the loops have a length within a range of about 2.0 inches and 3.0 inches. In some embodiments, the loop has a length or about 2.75 inches and/or within a range of about 2.6 and 2.8 inches.

The loops also preferably have a width within a range of about 0.20 inches and 0.40 inches. In some embodiments, the loop has a width of about 0.225 inches. In another embodiment, the loop has a width of about 0.35 inches.

Figure 37:
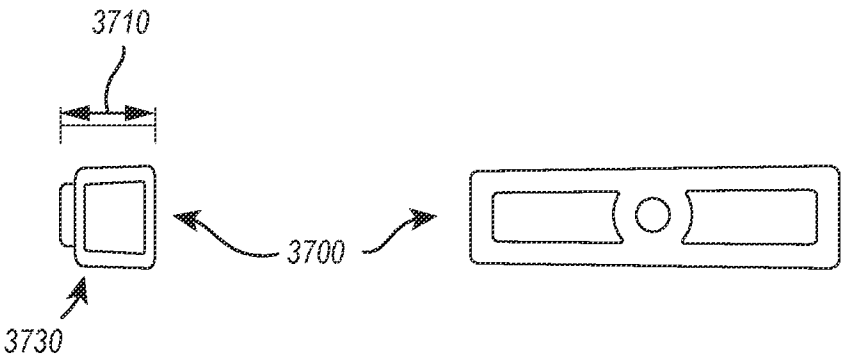
Figure 38:
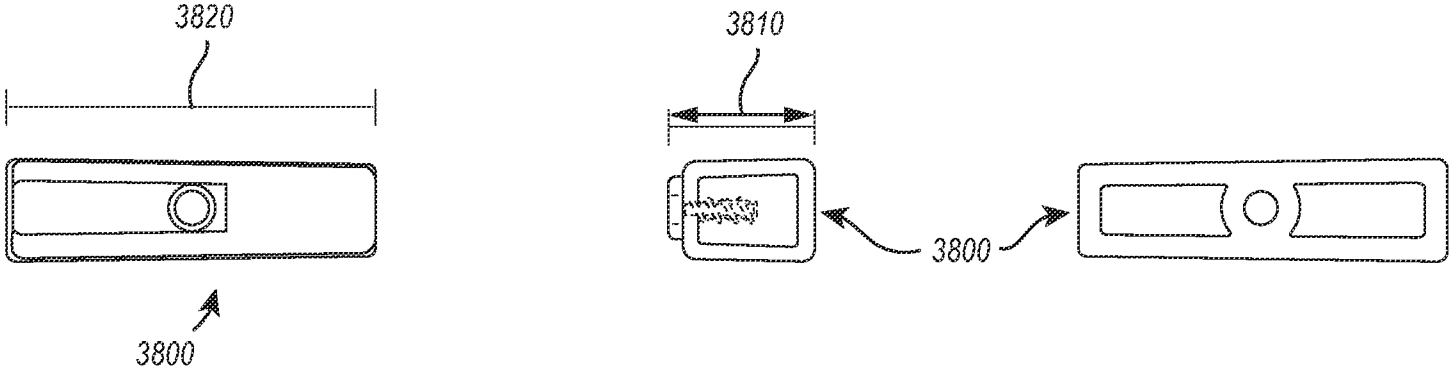

FIGS. 37 and 38 illustrate top, side and bottom views of spacing blocks 3700 and 3800. These spacing blocks 3700, 3800 correspond to the configurations of spacing blocks 1260A and 1260B, respectively. While not required, each spacing block may include a protruding formation 3730 that that has a circular shape that is configured to frictionally engage the opening/tapered portion of the holes formed in the clasping members. Such protrusions can be used to help position each spacing block within the hole(s) during use, such as when securing the spacing block(s) in a desired position within the loop area of a wearable clip by the screw(s) passing through the interchangeable backings, with the screw(s) being threaded into the spacing block. Threaded openings are present in both spacing blocks 3800 and 3700, even though they are only represented in spacing block 3800 by dashed lines to show conceptual placement of the threaded opening.

The widths and lengths of the different spacing blocks can be varied to accommodate different needs and preferences. In some embodiments, the spacing blocks have a length 3720, 3820 within a range of about 0.5 inches and 1.25 inches, as described previously, although it can be less than 0.5 inches and more than 1.25 inches. In some instances, the length 3720, 3829 is about 1 inch.

Additionally, the spacing blocks have a height or width 3710, 3810 within a range of about 0.2 inches and 0.5 inches, although it can be greater than 0.5 inches and less than 0.2 inches. In some instances, the width 3710, 3810 is about 0.25 inches. In other instances, the width is about 0.4 inches.

It will be appreciated that the scope of the invention also includes combinations of the various embodiments described herein, including, but not limited to, for example, a kit comprising a wearable clip and one or more interchangeable backings configured to be connected to a strap (e.g., belt), the kit comprising: wearable clip assembly configured to be selectably connected to a first belt, the wearable clip assembly comprising: a housing, the housing comprising: an interior receptacle formed between two end walls and two side walls and a top surface; and a magnet, the magnet being positioned within the substantially hollow receptacle area; and a first interchangeable backing comprising a back surface that encloses the interior receptacle when the interchangeable backing is secured to the housing, the interchangeable backing forming a first loop, the first loop being positioned opposite the interior receptacle from the back surface, between the back surface and one or more clasping members, the first loop extending between a first length between the one more clasping members and a first width between the back surface and the one or more clasping members for receiving and securing to a first belt having a first corresponding width and thickness.

Such a kit can also be configured to be selectably connected to a second belt having a different width or thickness than the first belt by a second interchangeable backing that has a second loop that is configured with at least one of a different width and/or a different length than the corresponding width/length of the first loop.

To facilitate placement of the wearable clip on the belt, the loop formed in the interchangeable backing of the clip may be open or closed. For instance, the first loop can comprise an open loop while the second loop comprises a closed loop, or alternatively, the first loop can comprise a closed loop while the second loop comprises an open loop.

The present invention may be embodied in other specific forms without departing from its spirit or essential characteristics. The described embodiments are to be considered in all respects only as illustrative and not restrictive. In fact, any combination of the features disclosed in any of the foregoing embodiments can be combined. The invention can incorporate any combination of the different features described herein, such that components and elements from one embodiment can be incorporated into or replace elements from any of the other embodiments described herein.

What is claimed is:

1. A wearable housing assembly configured in size and shape for housing a magnet and configured to be selectably connected to a wearable strap, the wearable housing assembly comprising:

a housing, the housing comprising:

an interior receptacle formed between two end walls and two side walls and a top surface; and a first plurality of mounting features configured to secure the housing to one or more interchangeable backings having a corresponding second plurality of mounting features;

a first interchangeable backing of the one or more interchangeable backings, the interchangeable backing comprising a back surface that encloses the interior receptacle when the interchangeable backing is secured to the housing by the first and second plurality of mounting features, the interchangeable backing forming a first loop, the first loop being positioned opposite the interior receptacle from the back surface, between the back surface and one or more clasping members, the first loop having a first length and a first width extending between the one more clasping members and the back surface, the one or more clasping members for receiving and securing to a strap or belt having a first corresponding width and thickness; and an adjustable sizing block that is securable to at least three different locations on the one or more clasping members while positioned within the first loop to change a length of the first loop to at least three different lengths, depending on which of the at least three different locations within the first loop the adjustable sizing block is secured, the one or more clasping members comprising at least three holes where the adjustable sizing block is selectively securable while being positioned within the first loop.

2. The wearable housing assembly recited in claim 1, further comprising a second interchangeable backing of the one or more interchangeable backings, the second interchangeable backing forming a second loop that has different dimensions than the first loop of the first interchangeable backing, by having a second length and width that is different than the first length and width and for receiving and securing to a strap or belt having a second corresponding thickness and width.

3. The wearable housing assembly recited in claim 1, the first interchangeable backing further comprising an adjustable sizing block and a third plurality of mounting features configured to secure the adjustable sizing block at different locations within the first loop.

4. The wearable housing assembly of claim 1, further comprising a magnet, the magnet being positioned within the interior receptacle.

5. The wearable housing assembly of claim 1, wherein each of the first and second mounting features comprise hole formations, and the wearable housing assembly further comprising screws that fasten the first and second mounting features together.

6. The wearable housing assembly of claim 1, wherein the first loop is a continuous closed loop.

7. The wearable housing assembly of claim 1, wherein the first loop is an open loop formed between opposing clasps that extend up from the back surface and curve towards each of the opposing clasps, with a space of separation existing between terminating ends of the opposing clasps.

8. The wearable housing assembly of claim 1, wherein an exterior of the top surface comprises a textured pattern formed by one or more grooves or projections formed on the top surface.

9. The wearable housing assembly of claim 1, wherein the wearable housing assembly further comprises nesting recesses formed in the housing and nesting structures formed into the one or more interchangeable backing.

10. A wearable housing assembly configured in size and shape for housing a magnet and configured to be selectably connected to a belt, the wearable housing assembly comprising:

a housing, the housing comprising:

an interior receptacle formed between two end walls and two side walls and a top surface; and a magnet, the magnet being positioned within the interior receptacle; and a first interchangeable backing comprising a back surface that encloses the interior receptacle when the interchangeable backing is secured to the housing, the interchangeable backing forming a loop, the loop being positioned opposite the interior receptacle from the back surface, between the back surface and one or more clasping members, wherein the wearable housing assembly further comprises nesting recesses formed in the housing and nesting structures formed into the one or more interchangeable backing.

11. A kit comprising a wearable clip and one or more interchangeable backings configured to be connected to one or more belts having different size configurations, the kit comprising:

a wearable clip assembly configured to be selectably connected to a first belt, the wearable clip assembly comprising:

a housing, the housing comprising:

an interior receptacle formed between two end walls and two side walls and a top surface; and a magnet, the magnet being positioned within the interior receptacle; and a first interchangeable backing comprising a back surface that encloses the interior receptacle when the interchangeable backing is secured to the housing, the interchangeable backing forming a first loop, the first loop being positioned opposite the interior receptacle from the back surface, between the back surface and one or more clasping members, the first loop extending having a first length and a first width extending between the back surface and the one or more clasping members for receiving and securing to a first belt having a first corresponding width and thickness; and a second interchangeable backing having a second loop that is configured with at least one of a different width or length than the first loop, wherein the wearable clip assembly is configured to be selectably connected to a second belt having a different width or thickness than the first belt by the second interchangeable backing, and wherein at least one of the first loop or the second loop comprises a closed loop.

12. The kit of claim 11, wherein each of the first and the second interchangeable backings is securable to the housing by four threaded holes formed within the housing.

13. The kit of claim 11, wherein the first loop comprises an open loop and the second loop comprises a closed loop.

14. The kit of claim 11, wherein the first loop comprises a different width than the second loop.

15. The kit of claim 11, wherein the first loop comprises a different length than the second loop.

16. The kit of claim 11, further comprising an adjustable sizing block that is securable to at least three different locations on the one or more clasping members while positioned within the first loop to change a length of the first loop to at least three different lengths, depending on which of the at least three different locations within the first loop the adjustable sizing block is secured.

17. The kit of claim 16, wherein the at least three holes are formed within the one or more clasping members where the adjustable sizing block is selectively securable while being positioned within the first loop.

* * * * *